US009310107B2

(12) United States Patent
Yamashita et al.

(10) Patent No.: US 9,310,107 B2
(45) Date of Patent: Apr. 12, 2016

(54) AIR-CONDITIONING APPARATUS

(75) Inventors: Koji Yamashita, Tokyo (JP); Yuji Motomura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 726 days.

(21) Appl. No.: 13/511,314

(22) PCT Filed: Nov. 25, 2009

(86) PCT No.: PCT/JP2009/006335

§ 371 (c)(1),
(2), (4) Date: May 22, 2012

(87) PCT Pub. No.: WO2011/064814

PCT Pub. Date: Jun. 3, 2011

(65) Prior Publication Data

US 2012/0234032 A1 Sep. 20, 2012

(51) Int. Cl.
*F25B 29/00* (2006.01)
*F25B 13/00* (2006.01)
(Continued)

(52) U.S. Cl.
CPC ..... *F25B 13/00* (2013.01); *F25B 25/005* (2013.01); *F25B 2313/02732* (2013.01); *F25B 2313/02741* (2013.01); *F25B 2500/19* (2013.01); *F25B 2500/26* (2013.01); *F25B 2600/2513* (2013.01)

(58) Field of Classification Search
CPC ..... F25B 13/00; F25B 2313/02732; F25B 2313/02741; F25B 2500/19; F25B 2500/26; F25B 25/005; F25B 2600/2513
USPC ..... 62/159, 324.1
See application file for complete search history.

(56) References Cited

U.S. PATENT DOCUMENTS 4,320,452 A * 3/1982 Kempf et al. ..... 710/107
5,388,422 A * 2/1995 Hayashida et al. ..... 62/211
(Continued)

FOREIGN PATENT DOCUMENTS

JP 3-017475 A 1/1991
JP H03-17475 * 1/1991
(Continued)

OTHER PUBLICATIONS

Office Action issued on Dec. 4, 2013, by the Chinese Patent Office in corresponding Chinese Application No. 200980162573.1, and an English Translation of the Office Action. (6 pages).
International Search Report (PCT/ISA/210) issued on Jan. 26, 2010, by the Japanese Patent Office as the International Searching Authority for International Application No. PCT/JP2009/006335.

*Primary Examiner* — M. Alexandra Elve
*Assistant Examiner* — Henry Crenshaw
(74) *Attorney, Agent, or Firm* — Buchanan Ingersoll & Rooney PC

(57) ABSTRACT

An air-conditioning apparatus includes a refrigerant circuit having a plurality of expansion devices that controls a flow rate of the refrigerant flowing in each of a plurality of heat exchangers related to heat medium; a heat medium circuit having the heat exchangers related to heat medium and a use side heat exchanger that exchanges heat between the heat medium and air; heat medium flow switching devices disposed on an inflow side and an outflow side of the use side heat exchanger to mix or diverge the heat medium pertaining to the heat exchangers related to heat medium; and a controller that controls at least the heat medium flow switching device on the inflow side or the outflow side that controls the amount of heat exchange in each of the heat exchangers related to heat medium during cooling only operation mode or heating only operation mode.

14 Claims, 11 Drawing Sheets

(51) Int. Cl.
*F25D 21/00* (2006.01)
*F25B 25/00* (2006.01)

(56) References Cited

U.S. PATENT DOCUMENTS

| | | | | | |
|---|---|---|---|---|---|
| 5,943,879 | A * | 8/1999 | Sada et al. | ..... | 62/430 |
| 2006/0107683 | A1* | 5/2006 | Song et al. | ..... | 62/324.1 |
| 2006/0191286 | A1* | 8/2006 | Park et al. | ..... | 62/434 |
| 2007/0006602 | A1* | 1/2007 | Hayashi et al. | ..... | 62/190 |
| 2007/0180851 | A1* | 8/2007 | Fujiyoshi et al. | ..... | 62/480 |
| 2008/0083240 | A1* | 4/2008 | Su | ..... | 62/262 |
| 2011/0113802 | A1 | 5/2011 | Wakamoto et al. | | |

FOREIGN PATENT DOCUMENTS

| | | | |
|---|---|---|---|
| JP | 5-280818 | A | 10/1993 |
| JP | H05-280818 | * | 10/1993 |
| JP | 2001-289465 | A | 10/2001 |
| JP | 2002-106995 | * | 4/2002 |
| JP | 2003-343936 | A | 12/2003 |
| JP | 2004-108715 | * | 4/2004 |
| JP | 2004-108715 | A | 4/2004 |
| JP | 2005-140444 | A | 6/2005 |
| WO | WO 2009/133644 | A | 11/2009 |

* cited by examiner

FIG. 10

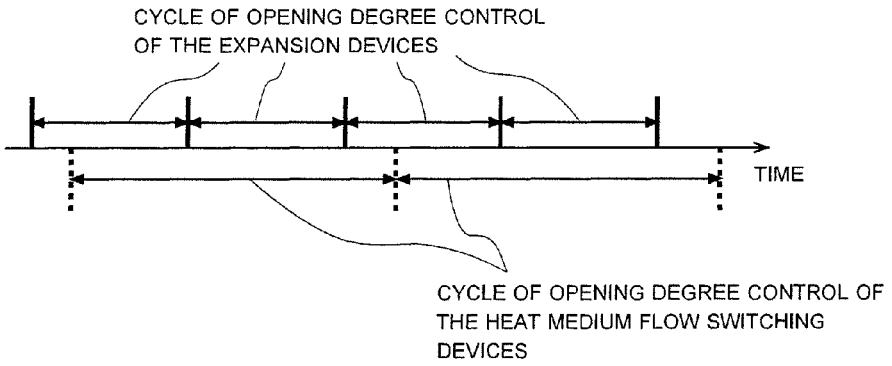

FIG. 11

| | HEAT MEDIUM FLOW SWITCHING DEVICES |
|---|---|
| AFTER INSTALLATION, DURING A START OF AN OPERATION OF THE COOLING ONLY OPERATION MODE OR THE HEATING ONLY OPERATION MODE | THE OPENING DEGREES ARE EACH SET SUCH THAT THE OPENING AREAS OF THE PASSAGES THAT ARE IN COMMUNICATION WITH THE HEAT EXCHANGERS RELATED TO HEAT MEDIUM ARE THE SAME OR ARE SUBSTANTIALLY THE SAME |
| WHEN STARTING THE OPERATION FOR A SECOND TIME OR AFTER | THE CORRECTION VALUE OF THE OPENING DEGREE CALCULATED LAST IN A PRECEDING OPERATION IS ADDED TO THE INITIAL OPENING DEGREE |

AIR-CONDITIONING APPARATUS

TECHNICAL FIELD

The present invention relates to an air-conditioning apparatus that is applied to, for example, a multi-air-conditioning apparatus for a building.

BACKGROUND ART

In conventional air-conditioning apparatuses such as a multi-air-conditioning apparatus for a building, cooling operation or heating operation is carried out by circulating a refrigerant between an outdoor unit that is a heat source device disposed outdoors and indoor units disposed indoors. Specifically, a conditioned space is cooled with the air that has been cooled by the refrigerant removing heat from the air and is heated with the air that has been heated by the refrigerant transferring its heat. Regarding the refrigerant used for such an air-conditioning apparatus, hydrofluorocarbon (HFC) refrigerant, for example, is typically used. An air-conditioning apparatus using a natural refrigerant, such as carbon dioxide ($CO_2$), has also been proposed.

There is also an air-conditioning apparatus having a different configuration represented by a chiller system. Further, in such an air-conditioning apparatus, cooling or heating is carried out such that cooling energy or heating energy is generated in a heat source device disposed outdoors; a heat medium such as water or brine is heated or cooled in a heat exchanger disposed in an outdoor unit; and the heat medium is conveyed to indoor units, such as a fan coil unit, a panel heater, or the like, disposed in the conditioning space (for example, see Patent Literature 1).

Moreover, there is a heat source side heat exchanger called a heat recovery chiller that connects a heat source unit to each indoor unit with four water pipings arranged therebetween, supplies cooled and heated water or the like simultaneously, and allows the cooling and heating in the indoor units to be selected freely (for example, see Patent Literature 2).

In addition, there is an air-conditioning apparatus that disposes a heat exchanger for a primary refrigerant and a secondary refrigerant near each indoor unit in which the secondary refrigerant is conveyed to the indoor unit (see Patent Literature 3, for example).

Furthermore, there is an air-conditioning apparatus that connects an outdoor unit to each branch unit including a heat exchanger with two pipings in which a secondary refrigerant is carried to the corresponding indoor unit (see Patent Literature 4, for example).

CITATION LIST

Patent Literature

Patent Literature 1: Japanese Unexamined Patent Application Publication No. 2005-140444 (page 4, FIG. 1, etc.)

Patent Literature 2: Japanese Unexamined Patent Application Publication No. 5-280818 (pages 4 and 5, FIG. 1, etc.)

Patent Literature 3: Japanese Unexamined Patent Application Publication No. 2001-289465 (pages 5 to 8, FIG. 1, FIG. 2, etc.)

Patent Literature 4: Japanese Unexamined Patent Application Publication No. 2003-343936 (page 5, FIG. 1)

SUMMARY OF INVENTION

Technical Problem

In an air-conditioning apparatus of the related art, such as a multi-air-conditioning apparatus for a building, there is a possibility of refrigerant leakage to, for example, an indoor space because the refrigerant is circulated to an indoor unit. On the other hand, in the air-conditioning apparatus disclosed in Patent Literature 1 and Patent Literature 2, the refrigerant does not pass through the indoor unit. However, in the air-conditioning apparatus disclosed in Patent Literature 1 and Patent Literature 2, the heat medium needs to be heated or cooled in a heat source unit disposed outside a structure, and needs to be carried to the indoor unit side. Accordingly, a circulation path of the heat medium is long. In this case, carrying of heat for a predetermined heating or cooling work using the heat medium consumes more amount of energy, in the form of conveyance power and the like, than the amount of energy consumed by the refrigerant. As the circulation path becomes longer, therefore, the conveyance power becomes markedly large. This indicates that energy saving can be achieved in an air-conditioning apparatus if the circulation of the heat medium can be controlled well.

In the air-conditioning apparatus disclosed in Patent Literature 2, the four pipings connecting the outdoor side and the indoor need to be arranged in order to allow cooling or heating to be selected in each indoor unit. Disadvantageously, there is little ease of construction. In the air-conditioning apparatus disclosed in Patent Literature 3, secondary medium circulating means such as a pump needs to be provided to each indoor unit. Disadvantageously, the system is not only costly but also has large noise, and is not practical. In addition, since the heat exchanger is disposed near each indoor unit, the risk of refrigerant leakage to a place near an indoor space cannot be eliminated.

In the air-conditioning apparatus disclosed in Patent Literature 4, a primary refrigerant that has exchanged heat flows into the same passage as that of the primary refrigerant before heat exchange. Accordingly, when a plurality of indoor units is connected, it is difficult for each indoor unit to exhibit its maximum capacity. Such a configuration wastes energy. Furthermore, each branch unit is connected to an extension piping with a total of four pipings, two for cooling and two for heating. This configuration is consequently similar to that of a system in which the outdoor unit is connected to each branching unit with four pipings. Accordingly, there is little ease of construction in such a system.

In consideration of the above, the present invention obtains an air-conditioning apparatus capable of improving energy efficiency and achieving energy savings by adjusting the flow rate of the refrigerant and the heat medium involved in the heat exchange.

Solution to Problem

The air-conditioning apparatus according to the invention includes a refrigeration cycle apparatus constituted by a refrigerant circuit, the refrigerant circuit being connected by piping including a compressor that compresses a refrigerant, a refrigerant flow switching device that switches a circulation path of the refrigerant, a heat source side heat exchanger for exchanging heat with the refrigerant, a plurality of heat exchangers related to heat medium each heating or cooling a heat medium different to the refrigerant, and a plurality of expansion devices each controlling a flow rate of the refrigerant flowing in each heat exchanger related to heat medium by pressure control; a heat medium side device constituted by a heat medium circuit, the heat medium circuit being connected by piping including the heat exchangers related to heat medium, a heat medium delivery device for circulating the heat medium pertaining to heat exchange of the heat exchangers related to heat medium, and a use side heat exchanger exchanging heat between the heat medium and air related to a conditioned space; heat medium flow switching devices disposed on an inflow side and an outflow side of the heat medium of the use side heat exchanger in the heat medium circuit, the heat medium flow switching devices merging or branching the heat medium by setting an opening area that is in communication with the heat exchangers related to heat medium at an arbitrary degree by controlling an opening degree; and a controller that controls an opening degree of the heat medium flow switching devices so that the flow rate of the heat medium flowing into each heat exchanger related to heat medium becomes the same during a cooling only operation mode or a heating only operation mode.

Advantageous Effects of Invention

In the invention, in the cooling only operation mode or the heating only operation mode, the opening degree of each heat medium flow switching device is controlled such that the amount of the heat medium that flows out into each heat exchanger related to heat medium is designed to be the same irrespective of the resistance in each passage. Accordingly, the refrigerant flow rate of each heat exchanger related to heat medium is set to be equal, so that the heat exchange amount therein is equal, resulting in an air-conditioning apparatus capable of improving energy efficiency and achieving energy savings.

BRIEF DESCRIPTION OF DRAWINGS

FIG. 10 illustrates how the expansion devices are controlled in accordance with an exemplary embodiment.

FIG. 11 illustrates how opening degrees of the heat medium flow switching devices are controlled in accordance with an exemplary embodiment.

DESCRIPTION OF EMBODIMENTS

Embodiments of the invention will be described below with reference to the drawings.

Figure 1:
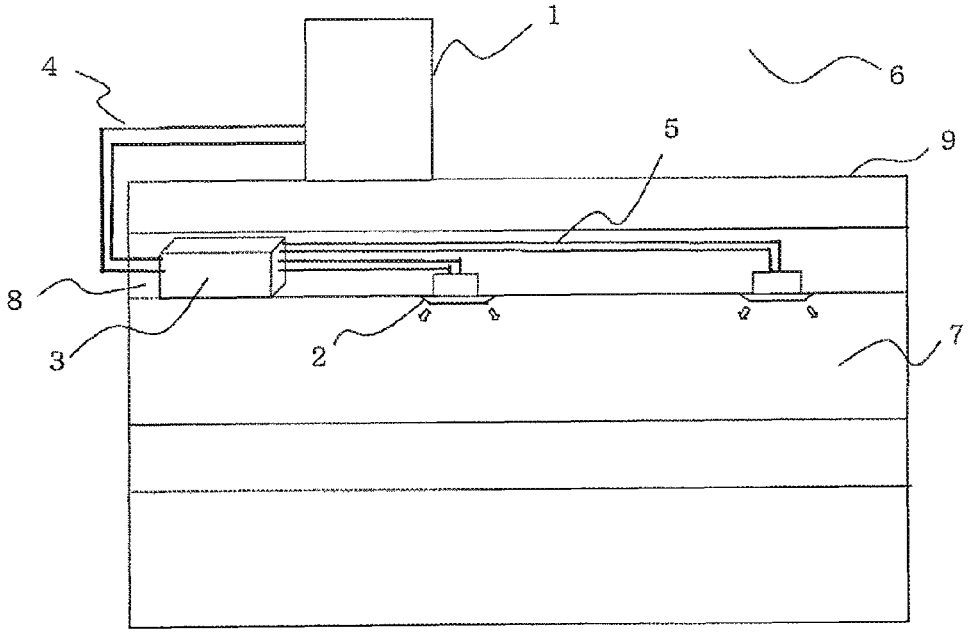
FIG. 1 is a system configuration diagram of an air-conditioning apparatus of Embodiment 1 of the present invention.
Figure 2:
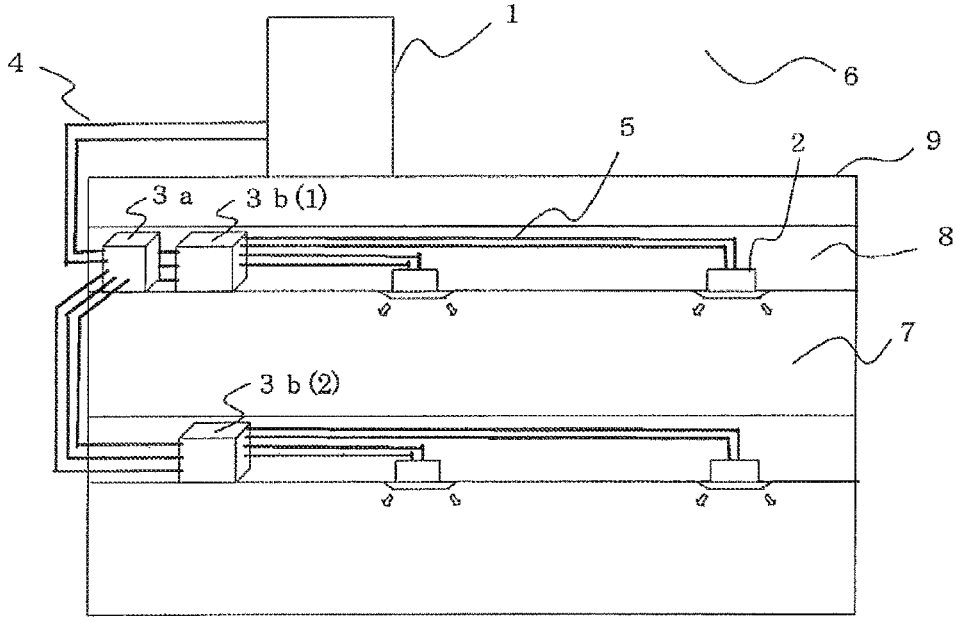
FIG. 2 is another system configuration diagram of an air-conditioning apparatus of Embodiment 1 of the present invention.

FIGS. 1 and 2 are schematic diagrams illustrating exemplary installations of the air-conditioning apparatus according to Embodiment of the invention. The exemplary installations of the air-conditioning apparatus will be described with reference to FIGS. 1 and 2. This air-conditioning apparatus uses refrigeration cycles (a refrigerant circuit A and a heat medium circuit B) in which refrigerants (a heat source side refrigerant or a heat medium) circulate such that a cooling mode or a heating mode can be freely selected as its operation mode in each indoor unit. It should be noted that the dimensional relationships of components in FIG. 1 and other subsequent figures may be different from the actual ones.

Referring to FIG. 1, the air-conditioning apparatus according to Embodiment 2 includes a single outdoor unit 1, functioning as a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are connected with refrigerant pipings 4 thorough which the heat source side refrigerant flows. The heat medium relay unit 3 and each indoor unit 2 are connected with pipings 5 (heat medium pipings) through which the heat medium flows. Cooling energy or heating energy generated in the outdoor unit 1 is delivered through the heat medium relay unit 3 to the indoor units 2.

Referring to FIG. 2, the air-conditioning apparatus according to Embodiment includes the single outdoor unit 1, the plurality of indoor units 2, a plurality of separated heat medium relay units 3 (a main heat medium relay unit 3*a* and sub heat medium relay units 3*b*) disposed between the outdoor unit 1 and the indoor units 2. The outdoor unit 1 and the main heat medium relay unit 3*a* are connected with the refrigerant pipings 4. The main heat medium relay unit 3*a* and the sub heat medium relay units 3*b* are connected with the refrigerant pipings 4. Each sub heat medium relay unit 3*b* and each indoor unit 2 are connected with the pipings 5. Cooling energy or heating energy generated in the outdoor unit 1 is delivered through the main heat medium relay unit 3*a* and the sub heat medium relay units 3*b* to the indoor units 2.

The outdoor unit 1 is typically disposed in an outdoor space 6 that is a space (e.g., a roof) outside a structure 9, such as a building, and is configured to supply cooling energy or heating energy through the heat medium relay unit 3 to the indoor units 2. Each indoor unit 2 is disposed at a position that can supply cooling air or heating air to an indoor space 7, which is a space (e.g., a living room) inside the structure 9, and supplies air for cooling or air for heating to the indoor space 7 that is a conditioned space. The heat medium relay unit 3 is configured with a housing separate from the outdoor unit 1 and the indoor units 2 such that the heat medium relay unit 3 can be disposed at a position different from those of the outdoor space 6 and the indoor space 7, and is connected to the outdoor unit 1 through the refrigerant pipings 4 and is connected to the indoor units 2 through the pipings 5 to convey cooling energy or heating energy, supplied from the outdoor unit 1 to the indoor units 2.

As illustrated in FIGS. 1 and 2, in the air-conditioning apparatus according to Embodiment, the outdoor unit 1 is connected to the heat medium relay unit 3 using two refrigerant pipings 4, and the heat medium relay unit 3 is connected to each indoor unit 2 using two pipings 5. As described above, in the air-conditioning apparatus according to Embodiment, each of the units (the outdoor unit 1, the indoor units 2, and the heat medium relay unit 3) is connected using two pipings (the refrigerant pipings 4 or the pipings 5), thus construction is facilitated.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2)) derived from the main heat medium relay unit 3*a*. This separation allows a plurality of sub heat medium relay units 3*b* to be connected to the single main heat medium relay unit 3*a*. In this configuration, the number of refrigerant piping 4 connecting the main heat medium relay unit 3*a* to each sub heat medium relay unit 3*b* is three. Detail of this circuit will be described in detail later (refer to FIG. 3A).

Furthermore, FIGS. 1 and 2 illustrate a state where each heat medium relay unit 3 is disposed in the structure 9 but in a space different from the indoor space 7, for example, a space above a ceiling (hereinafter, simply referred to as a "space 8"). The heat medium relay unit 3 can be disposed in other spaces, such as a common space where an elevator or the like is installed. In addition, although FIGS. 1 and 2 illustrate a case in which the indoor units 2 are of a ceiling-mounted cassette type, the indoor units are not limited to this type and, for example, a ceiling-concealed type, a ceiling-suspended type, or any type of indoor unit may be used as long as the unit can blow out heating air or cooling air into the indoor space 7 directly or through a duct or the like.

FIGS. 1 and 2 illustrate the case in which the outdoor unit 1 is disposed in the outdoor space 6. The arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 when the used outdoor unit 1 is of a water-cooled type. Even when the outdoor unit 1 is disposed in such a place, no problem in particular will occur.

Furthermore, the heat medium relay unit 3 can be disposed near the outdoor unit 1. It should be noted that when the distance from the heat medium relay unit 3 to the indoor unit 2 is excessively long, because power for conveying the heat medium is significantly large, the advantageous effect of energy saving is reduced. Additionally, the numbers of connected outdoor units 1, indoor units 2, and heat medium relay units 3 are not limited to those illustrated in FIGS. 1 and 2. The numbers thereof can be determined in accordance with the structure 9 where the air-conditioning apparatus according to Embodiment is installed.

Figure 3:
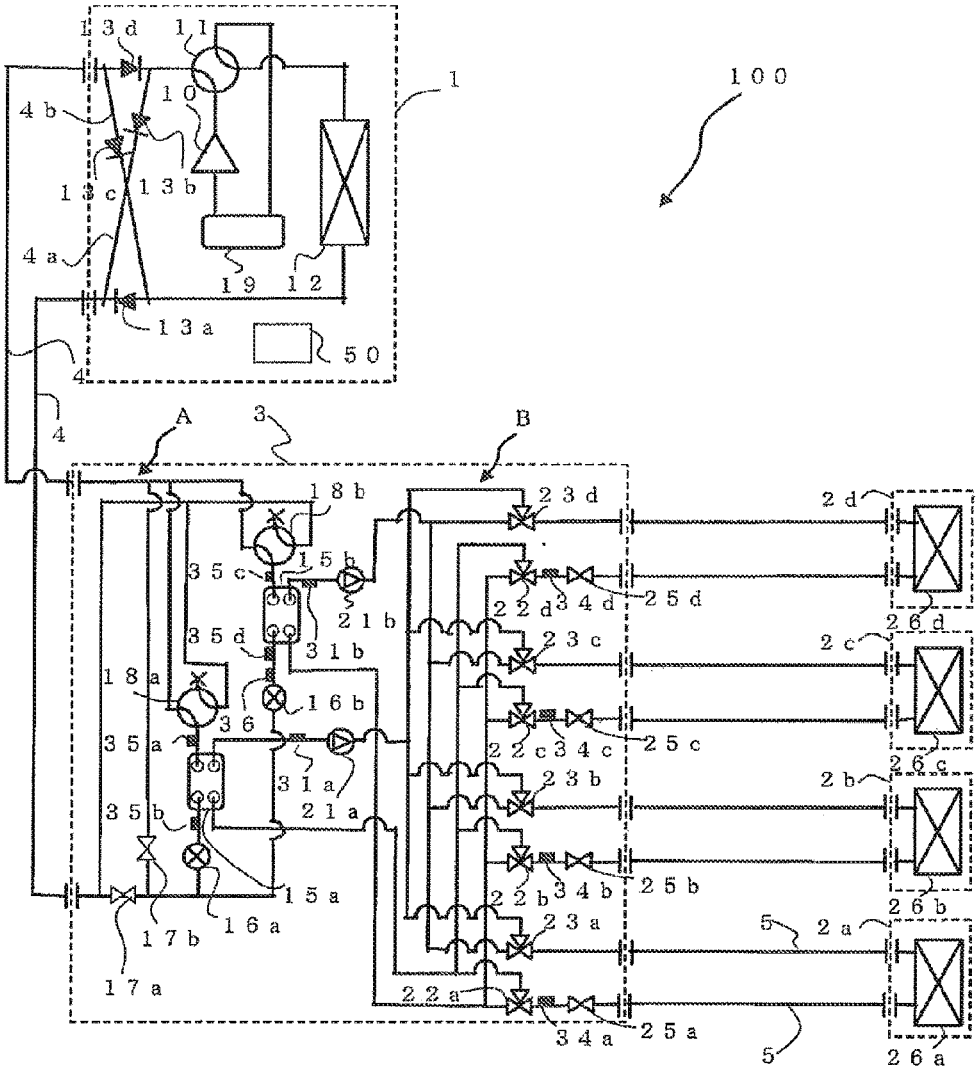
FIG. 3 is a system circuit diagram of an air-conditioning apparatus of Embodiment 1 of the present invention.

FIG. 3 is a schematic circuit diagram illustrating an exemplary circuit configuration of the air-conditioning apparatus (hereinafter, referred to as an "air-conditioning apparatus 100") according to Embodiment of the invention. The detailed configuration of the air-conditioning apparatus 100 will be described with reference to FIG. 3. As illustrated in FIG. 3, the outdoor unit 1 and the heat medium relay unit 3 are connected with the refrigerant pipings 4 through heat exchangers related to heat medium 15*a* and 15*b*, which serves as a heating/cooling device, included in the heat medium relay unit 3. Furthermore, the heat medium relay unit 3 and the indoor units 2 are connected with the pipings 5 through the heat exchangers related to heat medium 15*a* and 15*b*. In Embodiment 1, the heat exchangers related to heat medium 15*a* and 15*b* are assumed to be equal in size and the like. Accordingly, it is assumed that the performances of the two are the same under the same conditions. Here, descriptions may be given with suffixes being omitted when no discrimination is required in particular.

[Outdoor Unit 1]

The outdoor unit 1 includes a compressor 10, a first refrigerant flow switching device 11, such as a four-way valve, a heat source side heat exchanger 12, and an accumulator 19, which are connected in series with the refrigerant pipings 4. The outdoor unit 1 further includes a first connecting piping 4*a*, a second connecting piping 4*b*, a check valve 13*a*, a check valve 13*b*, a check valve 13*c*, and a check valve 13*d*. By providing the first connecting piping 4*a*, the second connecting piping 4*b*, the check valve 13*a*, the check valve 13*b*, the check valve 13*c*, and the check valve 13*d*, the heat source side refrigerant can be made to flow into the heat medium relay unit 3 in a constant direction irrespective of the operation requested by any indoor unit 2.

The compressor 10 sucks in the heat source side refrigerant and compress the heat source side refrigerant to a high-temperature high-pressure state. The compressor 10 may include, for example, a capacity-controllable inverter compressor. The first refrigerant flow switching device 11 switches the flow of the heat source side refrigerant between a heating operation (a heating only operation mode and a heating main operation mode) and a cooling operation (a cooling only operation mode and a cooling main operation mode). The heat source side heat exchanger 12 functions as an evaporator in the heating operation, functions as a condenser (or a radiator) in the cooling operation, exchanges heat between air supplied from the air-sending device, such as a fan (not illustrated), and the heat source side refrigerant, and evaporates and gasifies or condenses and liquefies the heat source side refrigerant. The accumulator 19 is disposed on the suction side of the compressor 10 and stores excess refrigerant.

The check valve 13*d* is provided in the refrigerant piping 4 between the heat medium relay unit 3 and the first refrigerant flow switching device 11 and permits the heat source side refrigerant to flow only in a predetermined direction (the direction from the heat medium relay unit 3 to the outdoor unit 1). The check valve 13*a* is provided in the refrigerant piping 4 between the heat source side heat exchanger 12 and the heat medium relay unit 3 and allows the heat source side refrigerant to flow only in a predetermined direction (the direction from the outdoor unit 1 to the heat medium relay unit 3). The check valve 13*b* is provided in the first connecting piping 4*a* and allows the heat source side refrigerant discharged from the compressor 10 to flow through the heat medium relay unit 3 during the heating operation. The check valve 13*c* is disposed in the second connecting piping 4*b* and allows the heat source side refrigerant, returning from the heat medium relay unit 3 to flow to the suction side of the compressor 10 during the heating operation.

The first connecting piping 4*a* connects the refrigerant piping 4, between the first refrigerant flow switching device 11 and the check valve 13*d*, to the refrigerant piping 4, between the check valve 13*a* and the heat medium relay unit 3, in the outdoor unit 1. The second connecting piping 4*b* is configured to connect the refrigerant piping 4, between the check valve 13*d* and the heat medium relay unit 3, to the refrigerant piping 4, between the heat source side heat exchanger 12 and the check valve 13*a*, in the outdoor unit 1. It should be noted that FIG. 3 illustrates a case in which the first connecting piping 4*a*, the second connecting piping 4*b*, the check valve 13*a*, the check valve 13*b*, the check valve 13*c*, and the check valve 13*d* are disposed, but the device is not limited to this case, and they may be omitted.

[Indoor Units 2]

The indoor units 2 each include a use side heat exchanger 26. The use side heat exchanger 26 is connected to a heat medium flow control device 25 and a second heat medium flow switching device 23 in the heat medium relay unit 3 with the pipings 5. Each of the use side heat exchangers 26 exchanges heat between air supplied from an air-sending device, such as a fan, (not illustrated) and the heat medium in order to generate air for heating or air for cooling supplied to the indoor space 7.

FIG. 3 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* each corresponding to the indoor units 2*a* to 2*d*. Note that as is the case of FIGS. 1 and 2, the number of connected indoor units 2 illustrated in FIG. 3 is not limited to four.

[Heat Medium Relay Unit 3]

The heat medium relay unit 3 includes the two heat exchangers related to heat medium 15, two expansion devices 16, two on-off devices 17, two second refrigerant flow switching devices 18, two pumps 21, four first heat medium flow switching devices 22, the four second heat medium flow switching devices 23, and the four heat medium flow control devices 25. An air-conditioning apparatus in which the heat medium relay unit 3 is separated into the main heat medium relay unit 3*a* and the sub heat medium relay unit 3*b* will be described later with reference to FIG. 3A.

Each of the two heat exchangers related to heat medium 15 (the heat exchanger related to heat medium 15*a* and the heat exchanger related to heat medium 15*b*) functions as a condenser (radiator) or an evaporator and exchanges heat between the heat source side refrigerant and the heat medium in order to transfer cooling energy or heating energy, generated in the outdoor unit 1 and stored in the heat source side refrigerant, to the heat medium. The heat exchangers related to heat medium 15 are plate heat exchangers, for example. The heat exchanger related to heat medium 15*a* is disposed between an expansion device 16*a* and a second refrigerant flow switching device 18*a* in a refrigerant circuit A and is used to cool the heat medium in the cooling and heating mixed operation mode. Additionally, the heat exchanger related to heat medium 15*b* is disposed between an expansion device 16*b* and a second refrigerant flow switching device 18*b* in a refrigerant circuit A and is used to heat the heat medium in the cooling and heating mixed operation mode.

The two expansion devices 16 (the expansion device 16*a* and the expansion device 16*b*) each have functions of a reducing valve and an expansion valve and are configured to reduce the pressure of and expand the heat source side refrigerant. The expansion device 16*a* is disposed upstream of the heat exchanger related to heat medium 15*a*, upstream regarding the heat source side refrigerant flow during the cooling operation. The expansion device 16*b* is disposed upstream of the heat exchanger related to heat medium 15*b*, upstream regarding the heat source side refrigerant flow during the cooling operation. Each of the two expansion devices 16 may include a component having a variably controllable opening degree, such as an electronic expansion valve.

The two on-off devices 17 (an on-off device 17*a* and an on-off device 17*b*) each include, for example, a two-way valve and open or close the refrigerant piping 4. The on-off device 17*a* is disposed in the refrigerant piping 4 on the inlet side of the heat source side refrigerant. The on-off device 17*b* is disposed in a piping connecting the refrigerant piping 4 on the inlet side of the heat source side refrigerant and the refrigerant piping 4 on an outlet side thereof. The two second refrigerant flow switching devices 18 (the second refrigerant flow switching devices 18*a* and 18*b*) each include, for example, a four-way valve and switch passages of the heat source side refrigerant in accordance with the operation mode. The second refrigerant flow switching device 18*a* is disposed downstream of the heat exchanger related to heat medium 15*a*, downstream regarding the heat source side refrigerant flow during the cooling operation. The second refrigerant flow switching device 18*b* is disposed downstream of the heat exchanger related to heat medium 15*b*, downstream regarding the heat source side refrigerant flow during the cooling only operation mode.

The two pumps 21 (a pump 21*a* and a pump 21*b*), serving as heat medium delivery devices, are configured to circulate the heat medium in the heat medium circuit cycle B. The pump 21*a* is disposed between the heat exchanger related to heat medium 15*a* and the second heat medium flow switching devices 23 and is driven to circulate the heat medium related to heat exchange of the heat exchanger related to heat medium 15*a*. The pump 21*b* is disposed between the heat exchanger related to heat medium 15*b* and the second heat medium flow switching devices 23 and is driven to circulate the heat medium related to heat exchange of the heat exchanger related to heat medium 15*b*. If there is no communication between the first heat medium flow switching devices 22 and if there is no communication between the second heat medium flow switching devices 23, a circulation path with two independent passages will be formed. Here, each of the two pumps 21 may include, for example, a capacity-controllable pump.

The four first heat medium flow switching devices 22 (first heat medium flow switching devices 22*a* to 22*d*) in Embodiment 1 each include, for example, three inlet/outlet ports (openings) and switches passages of the heat medium. Here, for example, a stepping motor driven mixing valve that can change flows between three-way passages is employed. Accordingly, the opening degree can be changed based on instructions from a controller 50. Thus, water hammer can be prevented. The first heat medium flow switching devices 22 are arranged so that the number thereof (four in this case) corresponds to the installed number of indoor units 2. Each first heat medium flow switching device 22 is disposed on the outlet side of a heat medium passage of the corresponding use side heat exchanger 26 such that one of the three-ways is connected to the heat exchanger related to heat medium 15*a* (the pump 21*a*), another one of the three ways is connected to the heat exchanger related to heat medium 15*b* (the pump 21*b*), and the other one of the three ways is connected to the heat medium flow control device 25. Accordingly, for example, the heat medium flowing out of each use side heat exchanger 26 (the heat medium flow control device 25) can flow through the corresponding first heat medium flow switching device 22 that is in communication with either the heat exchanger related to heat medium 15*b* side or the heat exchanger related to heat medium 15*a* side. Furthermore, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2.

The four second heat medium flow switching devices 23 (second heat medium flow switching devices 23*a* to 23*d*) in Embodiment 1 each include, for example, three inlet/outlet ports (openings) and switches passages of the heat medium. Here, a device that can change flows between the three-way passages, such as a stepping motor driven mixing valve, is employed as each four first heat medium flow switching device 22 in which its opening degree can be changed based on the number of pulses or the like. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the use side heat exchanger 26. Accordingly, for example, while in communication with either the heat exchanger related to heat medium 15*b* side or the heat exchanger related to heat medium 15*a* side, the heat medium can flow into the corresponding use side heat exchanger 26 (the heat medium flow control device 25). Furthermore, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2.

Here, since the first heat medium flow switching devices 22 and the second heat medium flow switching devices 23 of Embodiment 1 are each driven by a stepping motor, the devices can each perform switching as well as making all the passages communicate at an arbitrary rate of opening area. Here, owing to the flow of the heat medium, each second heat medium flow switching device 23 merges the heat medium of two passages and makes the heat medium flow into the corresponding use side heat exchanger 26. Further, each first heat medium flow switching device 22 diverges the heat medium flowing out from the corresponding use side heat exchanger 26 into two passages.

Here, in each of the first heat medium flow switching devices 22, the ratio of the opening area of the opening portions in which the heat medium flows out to each of the pumps 21*a* and 21*b* can be changed. In each of the second heat medium flow switching devices 23, the ratio of the opening area of the opening portions in which the heat medium flows into from the pumps 21*a* and 21*b* can be changed. In particular, a case in which the opening degree of the portions where the heat medium flows in from or flows out to the pumps 21*a* and 21*b* have substantially the same ratio (ratio 1:1) is referred to as "middle opening degree". Further, hereinafter, if there is no need to distinguish the first heat medium flow switching devices 22 and the second heat medium flow switching devices 23, the devices will be denoted as heat medium flow switching devices 22, 23.

The four heat medium flow control devices 25 (heat medium flow control devices 25*a* to 25*d*) each include, for example, a two-way valve using a stepping motor, for example, and is capable of controlling the area of opening of the piping 5 and controlling the flow rate (amount of flow per unit time) of the heat medium. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. In addition, each of the heat medium flow control devices 25 may be disposed on the inlet side of the heat medium passage of the corresponding use side heat exchanger 26.

The heat medium relay unit 3 includes various detecting devices (two first temperature sensors 31, four second temperature sensors 34, four third temperature sensors 35, and a pressure sensor 36). Information (temperature information and pressure information) detected by these detecting devices are transmitted to the controller 50 that performs integrated control of the operation of the air-conditioning apparatus 100 such that the information is used to control, for example, the driving frequency of the compressor 10, the rotation speed of the air-sending device (not illustrated), switching of the first refrigerant flow switching device 11, the driving frequency of the pumps 21, switching of the second refrigerant flow switching devices 18, and switching of passages of the heat medium. Herein, although the controller 50 is provided in the outdoor unit 1, this is not a limitation. For example, the processing function of the controller 50 may be split into controllers that are provided in the indoor units 2 and the heat medium relay unit 3. The controllers may perform processing while receiving and sending signals via communication wires and the like. Alternatively, the controller 50 may be provided outside of the outdoor unit 1.

Each of the two first temperature sensors 31 (a first temperature sensor 31*a* and a first temperature sensor 31*b*) detects the temperature of the heat medium flowing out of the corresponding heat exchanger related to heat medium 15, namely, the heat medium at an outlet of the corresponding heat exchanger related to heat medium 15 and may include, for example, a thermistor. The first temperature sensor 31*a* is disposed in the piping 5 on the inlet side of the pump 21*a* (the outlet side of the heat exchanger related to heat medium 15*a*). The first temperature sensor 31*b* is disposed in the piping 5 on the inlet side of the pump 21*b* (the outlet side of the heat exchanger related to heat medium 15*b*).

Each of the four second temperature sensors 34 (second temperature sensor 34*a* to 34*d*) is disposed between the first heat medium flow switching device 22 and the heat medium flow control device 25 and detects the temperature of the heat medium flowing out of the use side heat exchanger 26. A thermistor or the like may be used as the second temperature sensor 34. The second temperature sensors 34 are arranged so that the number (four in this case) corresponds to the installed number of indoor units 2. Furthermore, illustrated from the bottom of the drawing are the second temperature sensor 34*a*, the second temperature sensor 34*b*, the second temperature sensor 34*c*, and the second temperature sensor 34*d* so as to correspond to the respective indoor units 2.

Each of the four third temperature sensors 35 (third temperature sensors 35*a* to 35*d*) is disposed on the inlet side or the outlet side of a heat source side refrigerant of the heat exchanger related to heat medium 15 and detects the temperature of the heat source side refrigerant flowing into the heat exchanger related to heat medium 15 or the temperature of the heat source side refrigerant flowing out of the heat exchanger related to heat medium 15 and may include, for example, a thermistor. The third temperature sensor 35*a* is disposed between the heat exchanger related to heat medium 15*a* and the second refrigerant flow switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18*b*. The third temperature sensor 35*d* is disposed between the heat exchanger related to heat medium 15*b* and the expansion device 16*b*.

The pressure sensor 36 is disposed between the heat exchanger related to heat medium 15*b* and the expansion device 16*b*, similar to the installation position of the third temperature sensor 35*d*, and is configured to detect the pressure of the heat source side refrigerant flowing between the heat exchanger related to heat medium 15*b* and the expansion device 16*b*.

Further, the controller (not illustrated) includes, for example, a microcomputer and controls, for example, the driving frequency of the compressor 10, the rotation speed (including ON/OFF) of the air-sending device, switching of the first refrigerant flow switching device 11, driving of the pumps 21, the opening degree of each expansion device 16, on and off of each on-off device 17, switching of the second refrigerant flow switching devices 18, switching of the first heat medium flow switching devices 22, switching of the second heat medium flow switching devices 23, and the driving of each heat medium flow control device 25 on the basis of the information detected by the various detecting devices and an instruction from a remote control to carry out the operation modes which will be described later. Note that the controller may be provided to each unit, or may be provided to the outdoor unit 1 or the heat medium relay unit 3.

The pipings 5 in which the heat medium flows include the pipings connected to the heat exchanger related to heat medium 15*a* and the pipings connected to the heat exchanger related to heat medium 15*b*. Each piping 5 is branched (into four in this case) in accordance with the number of indoor units 2 connected to the heat medium relay unit 3. The pipings 5 are connected by the first heat medium flow switching devices 22 and the second heat medium flow switching devices 23. Controlling the first heat medium flow switching devices 22 and the second heat medium flow switching devices 23 determines whether the heat medium flowing from the heat exchanger related to heat medium 15*a* is allowed to flow into the use side heat exchanger 26 or whether the heat medium flowing from the heat exchanger related to heat medium 15*b* is allowed to flow into the use side heat exchanger 26.

In the air-conditioning apparatus 100, the compressor 10, the first refrigerant flow switching device 11, the heat source side heat exchanger 12, the on-off devices 17, the second refrigerant flow switching devices 18, a refrigerant passage of the heat exchanger related to heat medium 15*a*, the expansion devices 16, and the accumulator 19 are connected through the refrigerant piping 4, thus forming the refrigerant circuit A. In addition, a heat medium passage of the heat exchanger related to heat medium 15*a*, the pumps 21, the first heat medium flow switching devices 22, the heat medium flow control devices 25, the use side heat exchangers 26, and the second heat medium flow switching devices 23 are connected through the pipings 5, thus forming the heat medium circuit B. In other words, the plurality of use side heat exchangers 26 are connected in parallel to each of the heat exchangers related to heat medium 15, thus turning the heat medium circuit B into a multi-system.

Accordingly, in the air-conditioning apparatus 100, the outdoor unit 1 and the heat medium relay unit 3 are connected through the heat exchanger related to heat medium 15*a* and the heat exchanger related to heat medium 15*b* arranged in the heat medium relay unit 3. The heat medium relay unit 3 and each indoor unit 2 are also connected through the heat exchanger related to heat medium 15*a* and the heat exchanger related to heat medium 15*b*. In other words, in the air-conditioning apparatus 100, the heat exchanger related to heat medium 15*a* and the heat exchanger related to heat medium 15*b* each exchange heat between the heat source side refrigerant circulating in the refrigerant circuit A and the heat medium circulating in the heat medium circuit B.

Figure 3A:
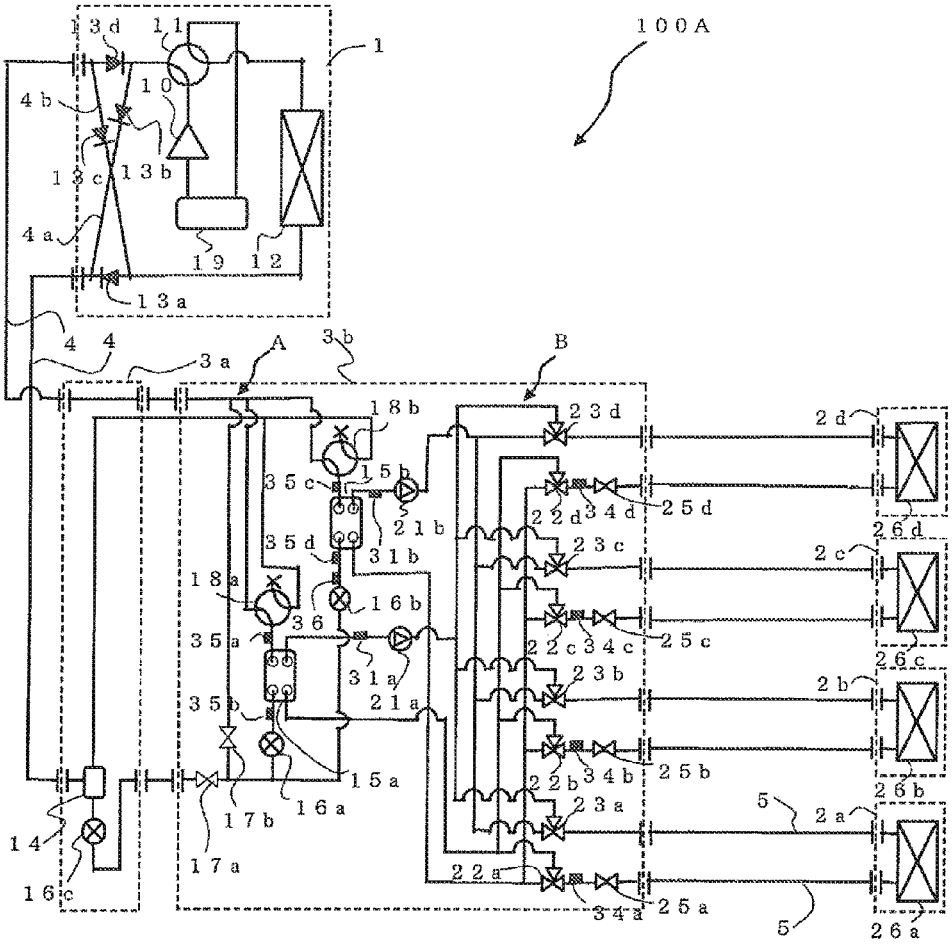
FIG. 3A is another system circuit diagram of an air-conditioning apparatus of Embodiment 1 of the present invention.

FIG. 3A is another schematic circuit diagram illustrating an exemplary circuit configuration of the air-conditioning apparatus (hereinafter, referred to as an "air-conditioning apparatus 100A") according to Embodiment of the invention. The configuration of the air-conditioning apparatus 100A in a case in which a heat medium relay unit 3 is separated into a main heat medium relay unit 3*a* and a sub heat medium relay unit 3*b* will be described with reference to FIG. 3A. As illustrated in FIG. 3A, a housing of the heat medium relay unit 3 is separated such that the heat medium relay unit 3 is composed of the main heat medium relay unit 3*a* and the sub heat medium relay unit 3*b*. This separation allows a plurality of sub heat medium relay units 3*b* to be connected to the single main heat medium relay unit 3*a* as illustrated in FIG. 2.

The main heat medium relay unit 3*a* includes a gas-liquid separator 14 and an expansion device 16*c*. Other components are arranged in the sub heat medium relay unit 3*b*. The gas-liquid separator 14 is connected to a single refrigerant piping 4 connected to the outdoor unit 1 and is connected to two refrigerant pipings 4 connected to the heat exchanger related to heat medium 15*a* and the heat exchanger related to heat medium 15*b* in the sub heat medium relay unit 3*b*, and is configured to separate the heat source side refrigerant supplied from the outdoor unit 1 into vapor refrigerant and liquid refrigerant. The expansion device 16*c*, disposed downstream regarding the flow direction of the liquid refrigerant flowing out of the gas-liquid separator 14, has functions of a reducing valve and an expansion valve and reduces the pressure of and expands the heat source side refrigerant. During a cooling and heating mixed operation, the expansion device 16*c* is controlled such that the pressure state of the refrigerant on an outlet side of the expansion device 16*c* is medium pressure. The expansion device 16*c* may include a component having a variably controllable opening degree, such as an electronic expansion valve. This arrangement allows a plurality of sub heat medium relay units 3*b* to be connected to the main heat medium relay unit 3*a*.

Various operation modes executed by the air-conditioning apparatus 100 will be described below. The air-conditioning apparatus 100 allows each indoor unit 2, on the basis of an instruction from the indoor unit 2, to perform a cooling operation or heating operation. Specifically, the air-conditioning apparatus 100 may allow all of the indoor units 2 to perform the same operation and also allow each of the indoor units 2 to perform different operations. It should be noted that since the same applies to operation modes carried out by the air-conditioning apparatus 100A, description of the operation modes carried out by the air-conditioning apparatus 100A is omitted. In the following description, the air-conditioning apparatus 100 includes the air-conditioning apparatus 100A.

As regards the operation modes of the above air-conditioning apparatus, there is a heating only operation mode in which all of the driving indoor units 2 perform heating operation, and a cooling only operation mode in which all of the driving indoor units 2 perform cooling operation. Further, there is a cooling main operation mode, in which cooling load is larger, and a heating main operation mode, in which heating load is larger (the cooling main operation mode and the heating main operation mode may be collectively referred to as a "cooling and heating mixed operation mode"). The operation modes will be described below with respect to the flow of the heat source side refrigerant and that of the heat medium.

[Cooling Only Operation Mode]

Figure 4:
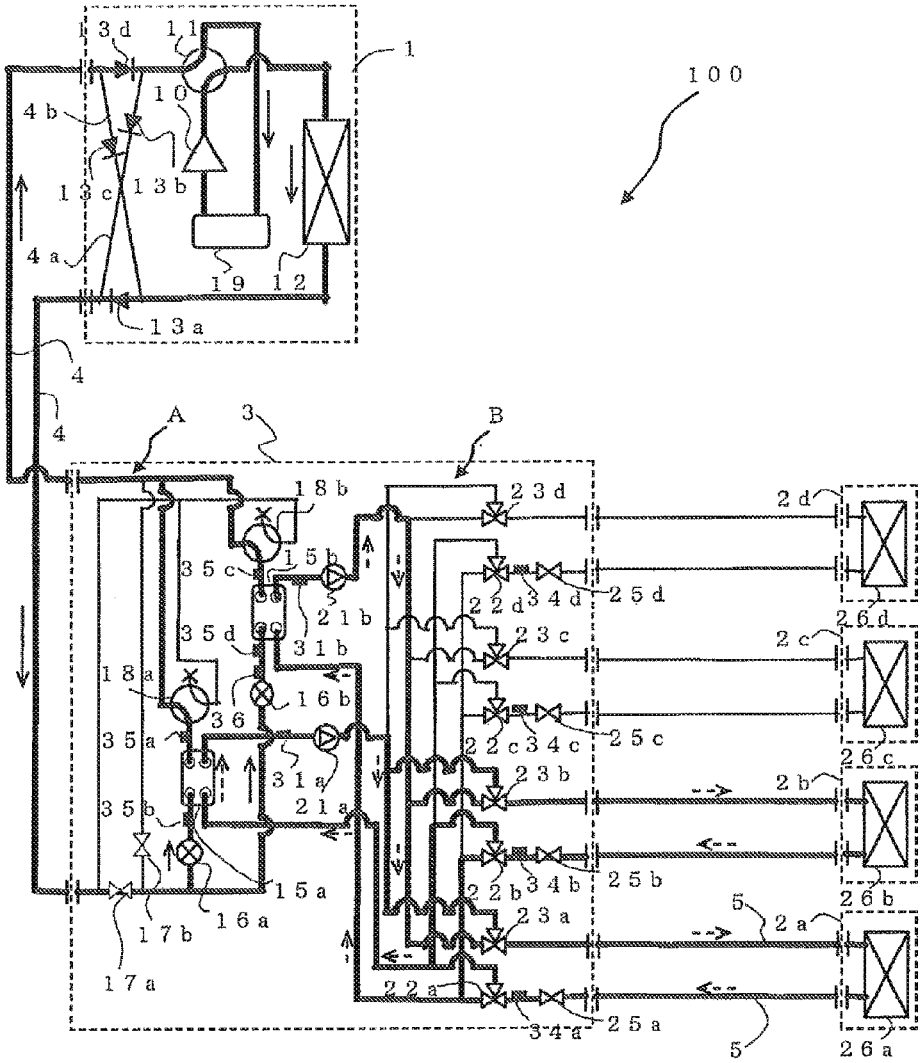
FIG. 4 is a system circuit diagram of an air-conditioning apparatus of Embodiment 1 during cooling only operation mode.

FIG. 4 is a refrigerant circuit diagram illustrating the flows of refrigerants in the cooling only operation mode of the air-conditioning apparatus 100. The cooling only operation mode will be described with respect to a case in which cooling loads are generated only in the use side heat exchanger 26*a* and the use side heat exchanger 26*b* in FIG. 4. Furthermore, in FIG. 4, pipings indicated by thick lines indicate pipings through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 4.

In the cooling only operation mode illustrated in FIG. 4, in the outdoor unit 1, the first refrigerant flow switching device 11 is switched such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant flowing out of the heat source side heat exchanger 12 passes through the check valve 13*a*, flows out of the outdoor unit 1, passes through the refrigerant piping 4, and flows into the heat medium relay unit 3. The high-pressure liquid refrigerant flowing into the heat medium relay unit 3 is branched after passing through an on-off device 17*a* and is expanded into a low-temperature low-pressure two-phase refrigerant by an expansion device 16*a* and an expansion device 16*b*.

This two-phase refrigerant flows into each of the heat exchanger related to heat medium 15*a* and the heat exchanger related to heat medium 15*b* functioning as an evaporator, removes heat from the heat medium circulating in the heat medium circuit B, cools the heat medium, and turns into a low-temperature low-pressure gas refrigerant. The gas refrigerant, which has flowed out of each of the heat exchanger related to heat medium 15*a* and the heat exchanger related to heat medium 15*b*, flows out of the heat medium relay unit 3 through the second refrigerant flow switching device 18*a* and the second refrigerant flow switching device 18*b*, respectively, passes through the refrigerant piping 4, and again flows into the outdoor unit 1. The refrigerant flowing into the outdoor unit 1 passes through the check valve 13*d*, the first refrigerant flow switching device 11, and the accumulator 19, and is again sucked into the compressor 10.

At this time, the opening degree of the expansion device 16*a* is controlled such that superheat (the degree of superheat) is constant, the superheat being obtained as the difference between a temperature detected by the third temperature sensor 35*a* and that detected by the third temperature sensor 35*b*. Similarly, the opening degree of the expansion device 16*b* is controlled such that superheat is constant, in which the superheat is obtained as the difference between a temperature detected by a third temperature sensor 35*c* and that detected by a third temperature sensor 35*d*. In addition, the on-off device 17*a* is opened and the on-off device 17*b* is closed.

Next, the flow of the heat medium in the heat medium circuit B will be described.

In the cooling only operation mode, both the heat exchanger related to heat medium 15*a* and the heat exchanger related to heat medium 15*b* transfer cooling energy of the heat source side refrigerant to the heat medium, and the pump 21*a* and the pump 21*b* allow the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air in each of the use side heat exchanger 26*a* and the use side heat exchanger 26*b*, thus cools the indoor space 7.

Then, the heat medium flows out of each of the use side heat exchanger 26*a* and the use side heat exchanger 26*b* and flows into the heat medium flow control device 25*a* and the heat medium flow control device 25*b*. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used. At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established. By using the heat exchanger related to heat medium 15*a* and heat exchanger related to heat medium 15*b* to cool the heat medium and by increasing the heat transfer area, cooling operation can be efficiently carried out.

Upon carrying out the cooling only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 4, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 5:
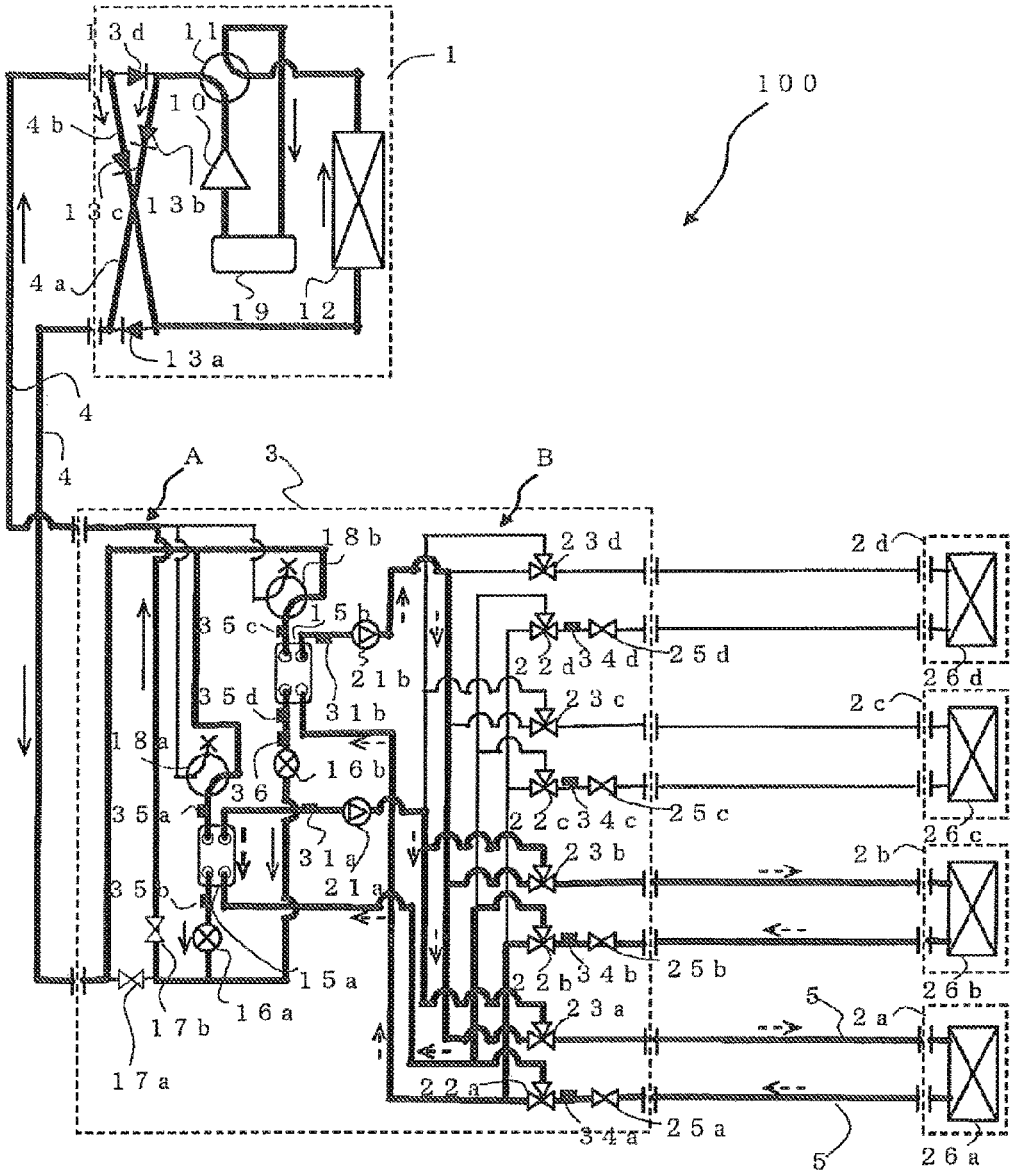
FIG. 5 is a system circuit diagram of an air-conditioning apparatus of Embodiment 1 during heating only operation mode.

FIG. 5 is a refrigerant circuit diagram illustrating the flows of the refrigerants in the heating only operation mode of the air-conditioning apparatus 100. The heating only operation mode will be described with respect to a case in which heating loads are generated only in the use side heat exchanger 26*a* and the use side heat exchanger 26*b* in FIG. 5. Furthermore, in FIG. 5, pipings indicated by thick lines indicate pipings through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 5.

In the heating only operation mode illustrated in FIG. 5, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant that has flowed out of the outdoor unit 1 passes through the refrigerant piping 4 and flows into the heat medium relay unit 3. The high-temperature high-pressure gas refrigerant that has flowed into the heat medium relay unit 3 is branched, passes through the second refrigerant flow switching device 18*a* and the second refrigerant flow switching device 18*b*, and flows into the heat exchanger related to heat medium 15*a* and the heat exchanger related to heat medium 15*b*.

The high-temperature high-pressure gas refrigerant that has flowed into each of the heat exchanger related to heat medium 15*a* and the heat exchanger related to heat medium 15*b* is condensed and liquefied into a high-pressure liquid refrigerant while transferring heat to the heat medium circulating in the heat medium cycle B. The liquid refrigerant flowing out of the heat exchanger related to heat medium 15*a* and that flowing out of the heat exchanger related to heat medium 15*b* are expanded into a low-temperature low-pressure, two-phase refrigerant in the expansion device 16*a* and the expansion device 16*b*. This two-phase refrigerant passes through the on-off device 17*b*, flows out of the heat medium relay unit 3, passes through the refrigerant piping 4, and again flows into the outdoor unit 1. The refrigerant flowing into the outdoor unit 1 flows through the second connecting piping 4*b*, passes through the check valve 13*c*, and flows into the heat source side heat exchanger 12 functioning as an evaporator.

Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

At that time, the opening degree of the expansion device 16*a* is controlled such that subcooling (degree of subcooling) obtained as the difference between a saturation temperature converted from a pressure detected by the pressure sensor 36 and a temperature detected by the third temperature sensor 35*b* is constant. Similarly, the opening degree of the expansion device 16*b* is controlled such that subcooling is constant, in which the subcooling is obtained as the difference between the value indicating the saturation temperature converted from the pressure detected by the pressure sensor 36 and a temperature detected by the third temperature sensor 35*d*. In addition, the on-off device 17*a* is closed and the on-off device 17*b* is opened. Note that when a temperature at the middle position of the heat exchangers related to heat medium 15 can be measured, the temperature at the middle position may be used instead of the pressure sensor 36. Accordingly, the system can be constructed inexpensively.

Next, the flow of the heat medium in the heat medium circuit B will be described.

In the heating only operation mode, both of the heat exchanger related to heat medium 15*a* and the heat exchanger related to heat medium 15*b* transfer heating energy of the heat source side refrigerant to the heat medium, and the pump 21*a* and the pump 21*b* allow the heated heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. Then the heat medium transfers heat to the indoor air in the use side heat exchanger 26*a* and the use side heat exchanger 26*b*, thus heats the indoor space 7.

Then, the heat medium flows out of each of the use side heat exchanger 26*a* and the use side heat exchanger 26*b* and flows into the heat medium flow control device 25*a* and the heat medium flow control device 25*b*. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger related to heat medium 15*a* and the heat exchanger related to heat medium 15*b*, and is again sucked into the pump 21*a* and the pump 21*b*.

Note that in the pipings 5 of each use side heat exchanger 26, the heat medium is directed to flow from the second heat medium flow switching device 23 through the heat medium flow control device 25 to the first heat medium flow switching device 22. The air conditioning load required in the indoor space 7 can be satisfied by controlling the difference between a temperature detected by the first temperature sensor 31*a* or a temperature detected by the first temperature sensor 31*b* and a temperature detected by the second temperature sensor 34 so that difference is maintained at a target value. As regards a temperature at the outlet of each heat exchanger related to heat medium 15, either of the temperature detected by the first temperature sensor 31*a* or that detected by the first temperature sensor 31*b* may be used. Alternatively, the mean temperature of the two may be used.

At this time, the opening degree of each of the first heat medium flow switching devices 22 and the second heat medium flow switching devices 23 are set to a medium degree such that passages to both of the heat exchanger related to heat medium 15*a* and the heat exchanger related to heat medium 15*b* are established. Although the use side heat exchanger 26*a* should essentially be controlled on the basis of the difference between a temperature at its inlet and that at its outlet, since the temperature of the heat medium on the inlet side of the use side heat exchanger 26 is substantially the same as that detected by the first temperature sensor 31*b*, the use of the first temperature sensor 31*b* can reduce the number of temperature sensors, so that the system can be constructed inexpensively.

Upon carrying out the heating only operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 5, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 6:
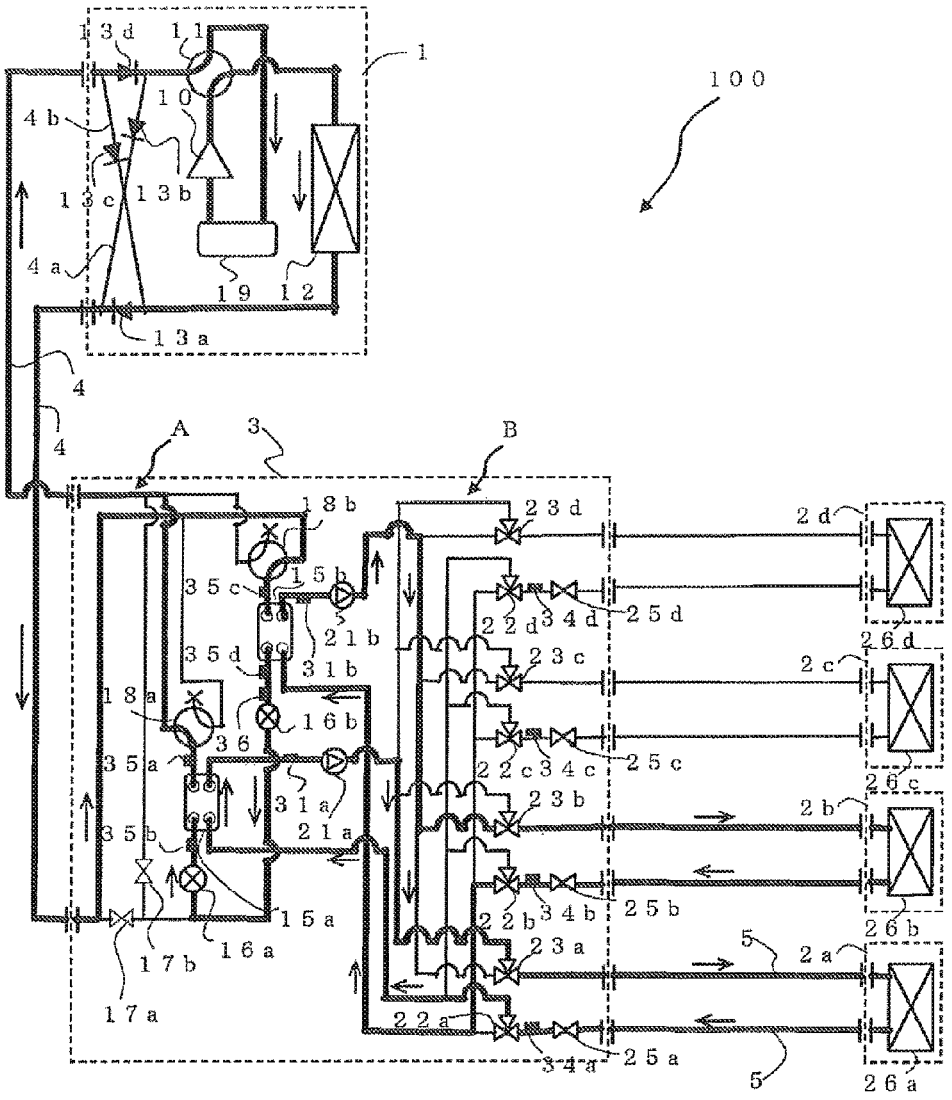
FIG. 6 is a system circuit diagram of an air-conditioning apparatus of Embodiment 1 during cooling main operation mode.

FIG. 6 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 6. Furthermore, in FIG. 6, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 6.

In the cooling main operation mode illustrated in FIG. 6, in the outdoor unit 1, the first refrigerant flow switching device 11 is switched such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are closed such that the heat medium circulates between the heat exchanger related to heat medium 15*a* and the use side heat exchanger 26*a*, and between the heat exchanger related to heat medium 15*b* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 flows through the first refrigerant flow switching device 11 into the heat source side heat exchanger 12. The refrigerant is condensed into a two-phase refrigerant in the heat source side heat exchanger 12 while transferring heat to the outdoor air. The two-phase refrigerant flowing out of the heat source side heat exchanger 12 passes through the check valve 13*a*, flows out of the outdoor unit 1, passes through the refrigerant piping 4, and flows into the heat medium relay unit 3. The two-phase refrigerant flowing into the heat medium relay unit 3 passes through the second refrigerant flow switching device 18*b* and flows into the heat exchanger related to heat medium 15*b*, functioning as a condenser.

The two-phase refrigerant that has flowed into the heat exchanger related to heat medium 15*b* is condensed and liquefied while transferring heat to the heat medium circulating in the heat medium cycle B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a*, functioning as an evaporator. The low-pressure two-phase refrigerant flowing into the heat exchanger related to heat medium 15*a* removes heat from the heat medium circulating in the heat medium circuit B, cools the heat medium, and turns into a low-pressure gas refrigerant. The gas refrigerant flows out of the heat exchanger related to heat medium 15*a*, passes through the second refrigerant flow switching device 18*a*, flows out of the heat medium relay unit 3, and flows into the outdoor unit 1 again through the refrigerant piping 4. The refrigerant flowing into the outdoor unit 1 passes through the check valve 13*d*, the first refrigerant flow switching device 11, and the accumulator 19, and is again sucked into the compressor 10.

At this time, the opening degree of the expansion device 16*b* is controlled such that superheat is constant, the superheat being obtained as the difference between a temperature detected by the third temperature sensor 35*a* and that detected by the third temperature sensor 35*b*. In addition, the expansion device 16*a* is fully opened, the on-off device 17*a* is closed, and the on-off device 17*b* is closed. Note that the opening degree of the expansion device 16*b* may be controlled such that subcooling is constant, in which the subcooling is obtained as the difference between a value indicating a saturation temperature converted from a pressure detected by the pressure sensor 36 and a temperature detected by the third temperature sensor 35*d*. Alternatively, the expansion device 16*b* may be fully opened and the expansion device 16*a* may control the superheat or the subcooling.

Next, the flow of the heat medium in the heat medium circuit B will be described.

In the cooling main operation mode, the heat exchanger related to heat medium 15*b* transfers heating energy of the heat source side refrigerant to the heat medium, and the pump 21*b* allows the heated heat medium to flow through the pipings 5. Furthermore, in the cooling main operation mode, the heat exchanger related to heat medium 15*a* transfers cooling energy of the heat source side refrigerant to the heat medium, and the pump 21*a* allows the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium transfers heat to the indoor air, thus heats the indoor space 7. In addition, in the use side heat exchanger 26*a*, the heat medium removes heat from the indoor air, thus cools the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight decrease of temperature, passes through the heat medium flow control device 25*b* and the first heat medium flow switching device 22*b*, flows into the heat exchanger related to heat medium 15*b*, and is sucked into the pump 21*b* again. The heat medium, which has passed through the use side heat exchanger 26*a* with a slight increase of temperature, passes through the heat medium flow control device 25*a* and the first heat medium flow switching device 22*a*, flows into the heat exchanger related to heat medium 15*a*, and is then sucked into the pump 21*a* again.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the cooling main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 6, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 7:
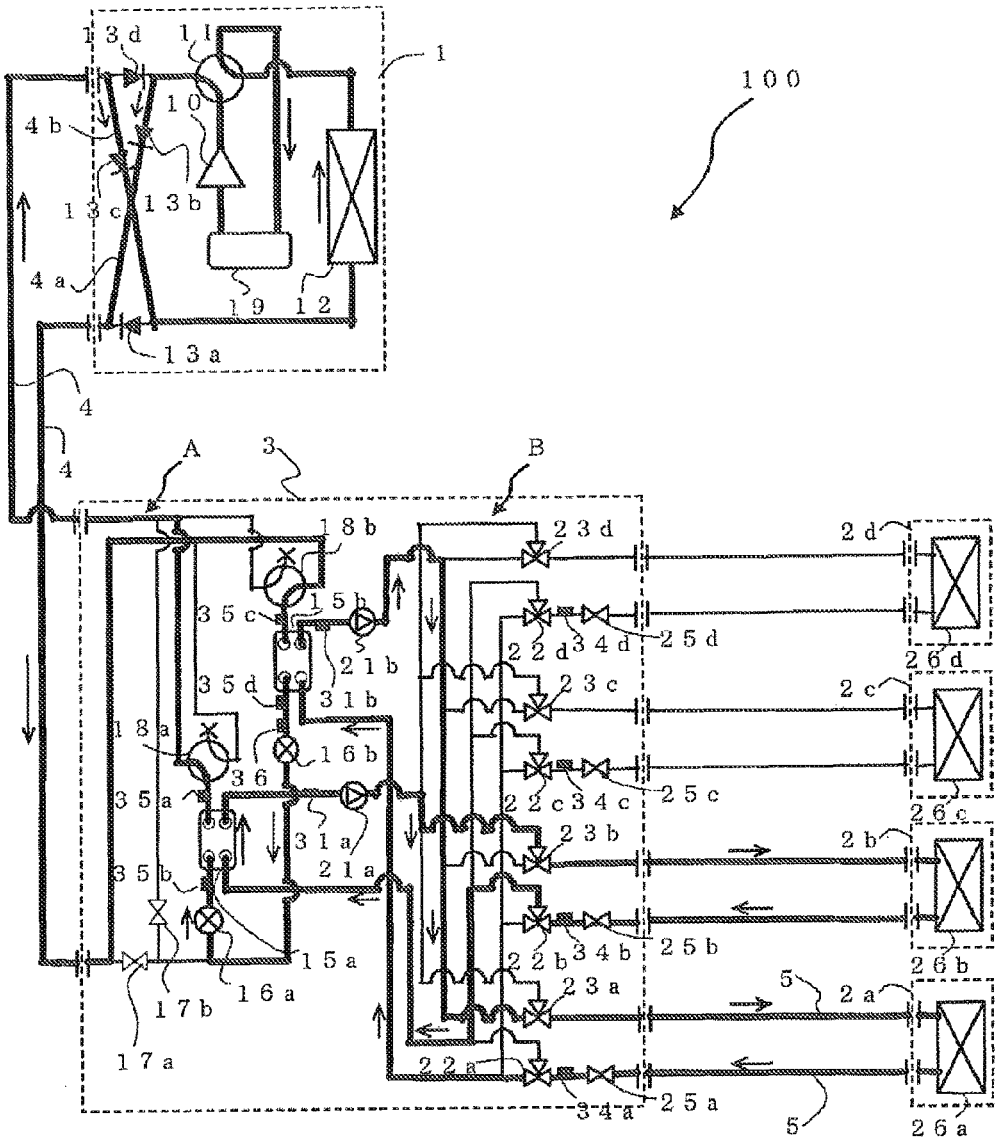
FIG. 7 is a system circuit diagram of an air-conditioning apparatus of Embodiment 1 during heating main operation mode.

FIG. 7 is a refrigerant circuit diagram illustrating the flows of the refrigerants in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 7. Furthermore, in FIG. 7, pipings indicated by thick lines correspond to pipings through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 7.

In the heating main operation mode illustrated in FIG. 7, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant therefrom. The high-temperature high-pressure gas refrigerant discharged from the compressor 10 passes through the first refrigerant flow switching device 11, flows through the first connecting piping 4*a*, passes through the check valve 13*b*, and flows out of the outdoor unit 1. The high-temperature high-pressure gas refrigerant that has flowed out of the outdoor unit 1 passes through the refrigerant piping 4 and flows into the heat medium relay unit 3. The high-temperature high-pressure gas refrigerant flowing into the heat medium relay unit 3 passes through the second refrigerant flow switching device 18*b* and flows into the heat exchanger related to heat medium 15*b*, functioning as a condenser.

The gas refrigerant that has flowed into the heat exchanger related to heat medium 15*b* is condensed and liquefied while transferring heat to the heat medium circulating in the heat medium cycle B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* removes heat from the heat medium circulating in the heat medium circuit B, is evaporated, and cools the heat medium. This low-pressure two-phase refrigerant flows out of the heat exchanger related to heat medium 15*a*, passes through the second refrigerant flow switching device 18*a*, flows out of the heat medium relay unit 3, passes through the refrigerant piping 4, and again flows into the outdoor unit 1.

The refrigerant flowing into the outdoor unit 1 passes through the check valve 13*c* and flows into the heat source side heat exchanger 12 functioning as an evaporator. Then, the refrigerant that has flowed into the heat source side heat exchanger 12 removes heat from the outdoor air in the heat source side heat exchanger 12 and thus turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

At this time, the opening degree of the expansion device 16*b* is controlled such that subcooling is constant, the subcooling being obtained as the difference between a value indicating a saturation temperature converted from a pressure detected by the pressure sensor 36 and a temperature detected by the third temperature sensor 35*b*. In addition, the expansion device 16*a* is fully opened, the on-off device 17*a* is closed, and the on-off device 17*b* is closed. Alternatively, the expansion device 16*b* may be fully opened and the expansion device 16*a* may control the subcooling.

Next, the flow of the heat medium in the heat medium circuit B will be described.

In the heating main operation mode, the heat exchanger related to heat medium 15*b* transfers heating energy of the heat source side refrigerant to the heat medium, and the pump 21*b* allows the heated heat medium to flow through the pipings 5. Furthermore, in the heating main operation mode, the heat exchanger related to heat medium 15*a* transfers cooling energy of the heat source side refrigerant to the heat medium, and the pump 21*a* allows the cooled heat medium to flow through the pipings 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium removes heat from the indoor air, thus cools the indoor space 7. In addition, in the use side heat exchanger 26*a*, the heat medium transfers heat to the indoor air, thus heats the indoor space 7. At this time, the function of each of the heat medium flow control device 25*a* and the heat medium flow control device 25*b* allows the heat medium to flow into the corresponding one of the use side heat exchanger 26*a* and the use side heat exchanger 26*b* while controlling the heat medium to a flow rate sufficient to cover an air conditioning load required in the indoor space. The heat medium, which has passed through the use side heat exchanger 26*b* with a slight increase of temperature, passes through the heat medium flow control device 25*b* and the first heat medium flow switching device 22*b*, flows into the heat exchanger related to heat medium 15*a*, and is sucked into the pump 21*a* again. The heat medium, which has passed through the use side heat exchanger 26*a* with a slight decrease of temperature, passes through the heat medium flow control device 25*a* and the first heat medium flow switching device 22*a*, flows into the heat exchanger related to heat medium 15*b*, and is again sucked into the pump 21*b*.

During this time, the function of the first heat medium flow switching devices 22 and the second heat medium flow switching devices 23 allow the heated heat medium and the cooled heat medium to be introduced into the respective use side heat exchangers 26 having a heating load and a cooling load, without being mixed. Note that in the pipings 5 of each of the use side heat exchanger 26 for heating and that for cooling, the heat medium is directed to flow from the second heat medium flow switching device 23 through the heat medium flow control device 25 to the first heat medium flow switching device 22. Furthermore, the difference between the temperature detected by the first temperature sensor 31*b* and that detected by the second temperature sensor 34 is controlled such that the difference is kept at a target value, so that the heating air conditioning load required in the indoor space 7 can be covered. The difference between the temperature detected by the second temperature sensor 34 and that detected by the first temperature sensor 31*a* is controlled such that the difference is kept at a target value, so that the cooling air conditioning load required in the indoor space 7 can be covered.

Upon carrying out the heating main operation mode, since it is unnecessary to supply the heat medium to each use side heat exchanger 26 having no heat load (including thermo-off), the passage is closed by the corresponding heat medium flow control device 25 such that the heat medium does not flow into the corresponding use side heat exchanger 26. In FIG. 7, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are fully closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Refrigerant Piping 4]

As described above, the air-conditioning apparatus 100 according to Embodiment 1 has several operation modes. In these operation modes, the heat source side refrigerant flows through the refrigerant pipings 4 connecting the outdoor unit 1 and the heat medium relay unit 3.

[Piping 5]

In some operation modes carried out by the air-conditioning apparatus 100 according to Embodiment 1, the heat medium, such as water or antifreeze, flows through the pipings 5 connecting the heat medium relay unit 3 and the indoor units 2.

[Cooperative Control of Second Heat Medium Flow Switching Devices 23 and Expansion Devices 16]

In the above description of the heating only operation mode and heating only operation mode, in order to substantially equalize the flow rate of the heat medium flowing in and out of the heat exchangers related to heat medium 15*a* and 15*b*, the opening degree of each of the first heat medium flow switching devices 22 and the second heat medium flow switching devices 23 are set to a medium degree. However, the passages between each of the first heat medium flow switching devices 22 and second heat medium flow switching devices 23 and each of the heat exchangers related to heat medium 15*a* and 15*b* are constituted by pipings, such as ones made of copper and the like, with a finite inside diameter that causes flow resistance (difficulty of flow) during flow of the refrigerant. Further, these pipings are housed along with other components in the housing constituting the heat medium relay unit 3. When attempting to miniaturize the heat medium relay unit 3 by devising the arrangement of each components, the piping in the housing becomes complex. Accordingly, it is difficult to make the length of the passages from the heat exchanger related to heat medium 15*a* to the first heat medium flow switching devices 22*a* to 22*d* and the passages from the heat exchanger related to heat medium 15*b* to the first heat medium flow switching devices 22*a* to 22*d* totally the same, for example. Further, when there is a bent portion in the piping, the bent portion will become a resistance in the passage of the heat medium flow. Furthermore, the resistance will be different when the bending angle is different.

Hence, in actuality, it is virtually impossible to make the passage resistance (pressure loss when the same amount of heat medium is made to flow) of the passages from the heat exchanger related to heat medium 15*a* to the first heat medium flow switching devices 22*a* to 22*d* and the passages from the heat exchanger related to heat medium 15*b* to the first heat medium flow switching devices 22*a* to 22*d* totally the same.

Accordingly, even if the first heat medium flow switching devices 22*a* to 22*d* are controlled to have medium opening degrees and to have the same opening areas, the flow rate of the heat medium flowing into the heat exchangers related to heat medium 15*a* and 15*b* will be different. For example, if the resistance of the passage from the first heat medium flow switching device 22*a* to the heat exchanger related to heat medium 15*b* is larger than the resistance of the passage from the first heat medium flow switching device 22*a* to the heat exchanger related to heat medium 15*a*, the flow rate of the heat medium to the heat exchanger related to heat medium 15*a* will be larger than the flow rate of the heat medium to the heat exchanger related to heat medium 15*b* when the first heat medium flow switching device 22*a* is made to have a medium opening degree.

Accordingly, the amount of heat exchange between the refrigerant and the heat medium in the heat exchanger related to heat medium 15*a* and the amount of heat exchange between the refrigerant and the heat medium in the heat exchanger related to heat medium 15*b* will differ, and the subcooling of the refrigerant on the outlet side of the heat exchanger related to heat medium 15*a* and the subcooling of the refrigerant on the outlet side of the heat exchanger related to heat exchange 15*b* will differ.

The controller 50 controls the opening degrees of the expansion devices 16*a* and 16*b* and changes the flow rates of the refrigerant passing through the heat exchangers related to heat medium 15*a* and 15*b*, so as to control the subcooling of the refrigerant on the outlet side of the heat exchangers related to heat medium 15*a* and 15*b* to a target value. Accordingly, the flow rate of the refrigerant flowing in the heat exchanger related to heat medium 15*a* and the flow rate of the refrigerant flowing in the heat exchanger related to heat medium 15*b* also differ. Since the design is made assuming that the flow rates of the refrigerant flowing in the heat exchangers related to heat medium 15*a* and 15*b* are the same, if the flow rates of the refrigerant differ, the maximum capacity of each of the heat exchangers related to heat medium 15*a* and 15*b* cannot be exhibited and the operating efficiency is reduced.

Hence, by cooperative control of the second heat medium flow switching devices 23 and the expansion devices 16 such that the flow rate of the refrigerant flowing in the heat exchanger related to heat medium 15*a* and the flow rate of the refrigerant flowing in the heat exchanger related to heat medium 15*b* becomes the same, improved efficiency and energy saving can be achieved. Next, the process associated with this cooperative control will be described.

Here, while the cooperative control of the second heat medium flow switching devices 23 and the expansion devices 16 is carried out so that the flow rates of the refrigerant flowing in the heat exchangers related to heat medium 15*a* and 15*b* becomes the same, when considering the heat load, passage resistance, and the like, it is better for the relationship of the flow rate of the heat medium flowing in and out of the use side heat exchangers 26 to be the same. Accordingly, in Embodiment 1, description is made assuming that the opening degree of each second heat medium flow switching device 23 and the corresponding first heat medium flow switching device 22 are the same.

Further, the first heat medium flow switching devices 22*a* to 22*d* and the second heat medium flow switching devices 22*a* and 22*d* are assumed to be disposed in the direction in which each passage on the heat exchanger related to heat medium 15*a* side is totally closed (0 opening area) and each passage on the heat exchanger related to heat medium 15*b* side is fully opened (maximum opening area) when the opening degree of each of the first heat medium flow switching devices 22*a* to 22*d* and each of the second heat medium flow switching devices 22*a* and 22*d* are zero and in which each passage on the heat exchanger related to heat medium 15*a* side is fully opened and each passage on the heat exchanger related to heat medium 15*b* side is totally closed when the opening degree of each of the first heat medium flow switching devices 22*a* to 22*d* and each of the second heat medium flow switching devices 22*a* and 22*d* are opened to their maximum. Accordingly, when the opening degree is changed to become larger (smaller), the flow rate of the heat medium to the heat exchanger related to heat medium 15*a* increases (decreases) and the flow rate of the heat medium to the heat exchanger related to heat medium 15*b* decreases (increases).

For example, during the heating only operation in which the heat medium is heated in the heat exchanger related to heat medium 15*a* and heat exchanger related to heat medium 15*b*, when the opening degrees of the first heat medium flow switching devices 22*a* to 22*d* and the second heat medium flow switching devices 23*a* to 23*d* are increased, the flow rate of the heat medium flowing into the heat exchanger related to heat medium 15*a* increases and the amount of heat exchange increases. Accordingly, the subcooling of the refrigerant on the outlet side of the heat exchanger related to heat medium 15*a* increases. On the other hand, the subcooling of the refrigerant on the outlet side of the heat exchanger related to heat medium 15*b* decreases where the flow rate of the heat medium is decreased.

Further, when the opening degrees of the first heat medium flow switching devices 22*a* to 22*d* and the second heat medium flow switching devices 23*a* to 23*d* are decreased, the flow rate of the heat medium flowing in the heat exchanger related to heat medium 15*a* decreases and the amount of heat exchange decreases. Accordingly, the subcooling of the refrigerant on the outlet side of the heat exchanger related to heat medium 15*a* decreases. On the other hand, the subcooling of the refrigerant on the outlet side of the heat exchanger related to heat medium 15*b* increases where the flow rate of the heat medium is decreased.

Further, as described above, the controller 50 controls the opening degree of each of the expansion device 16*a* and 16*b* so that the subcooling on the outlet side of the refrigerant of each of the heat exchanger related to heat medium 15*a* and 15*b* is at a target value. For example, when the subcooling of the refrigerant on the outlet side of the heat exchanger related to heat medium 15*a* increases, the subcooling of the refrigerant on the outlet side of the heat exchanger related to heat medium 15*a* is controlled to a target value by increasing the opening degree of the expansion device 16*a* and by increasing the flow rate of the refrigerant flowing in the heat exchanger related to heat medium 15*a*. When the subcooling of the refrigerant on the outlet side of the heat exchanger related to heat medium 15*b* decreases, the subcooling of the refrigerant on the outlet side of the heat exchanger related to heat medium 15*b* is controlled to a target value by decreasing the opening degree of the expansion device 16*b* and by decreasing the flow rate of the refrigerant flowing in the heat exchanger related to heat medium 15*b*.

As described above, when the opening degree of each of the first heat medium flow switching devices 22 and second heat medium flow switching devices 23 changes, the opening degree of each of the expansion devices 16*a* and 16*b* changes, and, thus, the subcooling of the refrigerant on the outlet side of the heat exchanger related to heat mediums 15*a* and 15*b* are controlled. When the resistance of the passages to the heat exchangers related to heat medium 15*a* and 15*b* on the heat medium side are different, the flow rate of the heat medium flowing in the heat exchangers related to heat medium 15*a* and 15*b* can be made the same by controlling the opening degrees of the first heat medium flow switching devices 22 and the second heat medium flow switching devices 23. Meanwhile, by changing the opening degrees of the expansion devices 16*a* and 16*b* so that the subcooling is at a target value, the flow rate of the refrigerant flowing in the heat exchangers related to heat medium 15*a* and 15*b* can be controlled to be the same.

Here, when the heat loads in each of the use side heat exchangers 26*a* to 26*d* are different, the flow rates of the heat medium flowing in each of the use side heat exchangers 26*a* to 26*d* differ. Accordingly, a flow sensing device of the heat medium, such as a flow sensor, is each disposed in either of the passages from the first heat medium flow switching devices 22*a* to 22*d* to the use side heat exchangers 26*a* to 26*d* or the passages from the second heat medium flow switching devices 23*a* to 23*d* to the use side heat exchangers 26*a* to 26*d*. It is most efficient if the controller controls the opening degrees of the first heat medium flow switching devices 22*a* to 22*d* and the second heat medium flow switching devices 23*a* to 23*d* on the basis of the flow rates of the heat medium detected by the flow sensing devices. In such a case, since the heat medium flow switching devices corresponding to each other, such as the first heat medium flow switching device 22*a* and the second heat medium flow switching device 23*a*, are on the inlet side and outlet side of the heat medium of the use side heat exchanger 26, it is preferable to control the direction and the opening degree to be the same. However, no problem will arise when the change amount of the opening degree of each first heat medium flow switching devices and each second heat medium flow switching devices is slightly different, and it may be possible to control only either one of the heat medium flow switching device on the inlet side and the outlet side.

On the other hand, even if there is no flow detecting device disposed, by controlling the first heat medium flow switching devices 22*a* to 22*d* and the second heat medium flow switching devices 23*a* to 23*d* that corresponds to the indoor units 2 that are in operation to have the same opening degree, the flow rate of the heat medium flowing in the heat exchangers related to heat medium 15*a* and 15*b* can be made the same.

For example, when all of the use side heat exchangers 26 are in heating operation, all of the opening degrees of the first heat medium flow switching devices 22*a* to 23*d* and the second heat medium flow switching devices 23*a* to 23*d* are changed by $\Delta P_{TVH1}$. Here, in order to control the subcooling of the refrigerant on the outlet of the heat exchangers related to heat medium 15*a* and 15*b* to a target value, the opening degrees of the expansion devices 16*a* and 16*b* changes by $\Delta P_{LEVa1}$ and $\Delta P_{LEVb1}$, respectively. Here, gain $G_{TLH}$ denotes the value calculated with the following equation (1). $G_{TLH}$ is a ratio of the change amount of the first heat medium flow switching devices 22*a* to 22*d* and the second heat medium flow switching device 23*a* to 23*d* to a mean value between the change amount of the opening degree $\Delta P_{LEVa1}$ of the expansion device 16*b* and the change amount of the opening degree $\Delta P_{LEVb1}$ of the expansion device 16*a*. This $G_{TLH}$ is calculated through experiment and the like in advance and is stored in the storage means of the controller 50 as data.

$$G_{TLH}=\Delta P_{TVN1}/\{0.5\times(\Delta P_{LEVa1}+\Delta P_{LEVb1})\} \quad (1)$$

Figure 8:
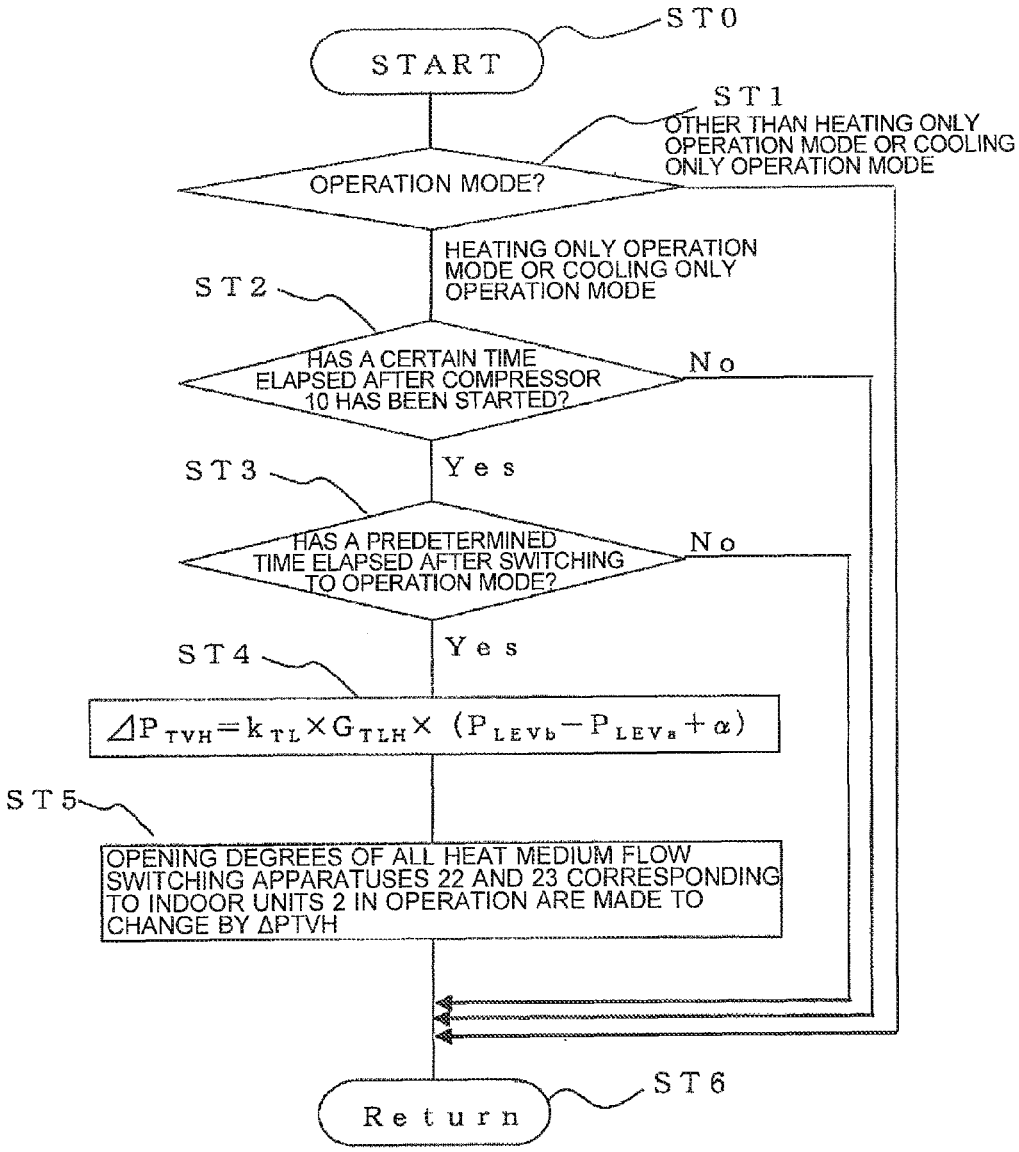
FIG. 8 is a flow chart of the operation of a controller 50 of Embodiment 1.

FIG. 8 is a diagram illustrating a flow chart of the controller 50 of Embodiment 1. The control of the opening degrees of the first heat medium flow switching devices 22*a* to 22*d* and the second heat medium flow switching devices 23*a* to 23*d* will be described with reference to FIG. 8. The controller 50 starts a control for each control cycle at a certain interval (every one minute, for example) (ST0). Then, it is determined whether the operation mode is in the heating only operation mode, the cooling only operation mode, or other operation modes (ST1).

When in the heating only operation mode or the cooling only operation mode, it is determined whether a certain time (ten minutes, for example) has elapsed after the start of the compressor 10 (ST2). When it is determined that a certain time has elapsed, it is further determined whether a predetermined time (ten minutes, for example) has elapsed after switching to the heating only operation mode or the cooling only operation mode (ST3). When it is determined that the predetermined time has elapsed after switching of the operation mode, calculation is performed with the following equation (2) (ST4).

$$\Delta P_{TVH}=k_{TL}\times G_{TLH}\times(P_{LEVb}-P_{LEVa}+a) \quad (2)$$

Here, $P_{LEVa}$ and $P_{LEVb}$ denote the opening degrees of the expansion devices 16*a* and 16*b*, respectively; $k_{TL}$ denotes a constant (relaxation coefficient, 0.3, for example); $G_{TLH}$ denotes the gain obtained with equation (1); $\Delta P_{TVH}$ denotes the change amount of the opening degrees (correction value of the opening degrees) of the first heat medium flow switching devices 22*a* to 22*b* and the second heat medium flow switching devices 23*a* to 23*b*; $\alpha$ denotes a constant for correcting the passage resistance of the piping in which the refrigerant flows in and out on the heat exchanger related to heat medium 15*a* side and the passage resistance of the piping in which the refrigerant flows in and out on the heat exchanger related to heat medium 15*b* side.

For example, in a case in which the passage resistant of the refrigerant piping on the heat exchanger related to heat medium 15*a* side is smaller than the passage resistant of the refrigerant piping on the heat exchanger related to heat medium 15*b* side, the opening degree of the expansion device 16*a* will be smaller than the opening degree of the expansion device 16*b* when the flow rate of the refrigerant flowing in the heat exchangers related to heat medium 15*a* and 15*b* are the same. Accordingly, if $P_{LEVb}-P_{LEVa}+\alpha$ is zero when a positive value (10, for example) is substituted for $\alpha$, that is, when the opening degree of $P_{LEVa}$ is smaller than $P_{LEVb}$ by $\alpha$, the change amount of the first heat medium flow switching devices 22*a* to 22*d* and the second heat medium flow switching devices 23*a* to 23*d* is zero. This $\alpha$ is obtained in advance by experiment and is stored. In Embodiment 1, $\alpha=0$.

Then the opening degrees of the first heat medium flow switching devices 22 and the second heat medium flow switching devices 23 corresponding to the indoor units 2 that are in operation are changed by $\Delta P_{TVH}$ (ST5), and the process is repeated (ST6). Further, the process is also repeated in ST1, ST2, and ST3, when it is determined that the operation mode is one other than the heating only operation mode or the cooling only operation mode, that a certain time has not elapsed after the start of the compressor 10, and that a predetermined time has not elapsed after switching to the heating only operation mode (ST6).

For example, it is assumed that gain $G_{TLH}$ is 10, relaxation coefficient $k_{TL}$ is 0.3, and the constant $\alpha$ is 0. Here, when the opening degree $P_{LEVa}$ of the expansion device 16*a* is 500 and the opening degree $P_{LEVb}$ of the expansion device 16*b* is 510, since each resistance of the heat medium pipings connected to the heat exchangers related to heat medium 15*a* and 15*b* are different, each flow rate of the heat medium flowing in the heat exchangers related to heat medium 15*a* and 15*b* are different. Accordingly, it is estimated that the flow rate of the refrigerant flowing in the heat exchanger related to heat medium 15*a* is less than the flow rate of the refrigerant flowing in the heat exchanger related to heat medium 15*b* in a fixed manner. Further, $\Delta P_{TVH}$ is 30 from equation (2). Accordingly, the controller 50 controls all of the first heat medium flow switching devices 22 and the second heat medium flow switching devices 23 corresponding to the indoor units 2 that are in operation such that the opening degree are increased by 30 pulses.

As described above, as regards the first heat medium flow switching devices 22*a* to 22*d* and the second heat medium flow switching devices 23*a* to 23*d*, when the opening degrees are zero, the passages that are in communication with the heat exchanger related to heat medium 15*a* side are fully closed and the passages that are in communication with the heat exchanger related to heat medium 15*b* are fully opened. On the other hand, when the opening degrees are at their maximum, the passages that are in communication with the heat exchanger related to heat medium 15*a* side are fully opened and the passages that are in communication with the heat exchanger related to heat medium 15*b* are fully closed.

Accordingly, increase of the opening degree increases the flow rate of the refrigerant flowing in the heat exchanger related to heat medium 15*a* and reduces the flow rate of the refrigerant flowing in the heat exchanger related to heat medium 15*b*. Therefore, control is carried out such that the flow rates of the refrigerant flowing in the two heat exchangers related to heat medium are equalized.

Further, the control method during cooling only operation mode is the same as that during the heating only operation mode. For example, gain $G_{TLH}$ of the heating only operation mode in equations (1) and (2) is replaced with gain $G_{TLC}$ of the cooling only operation mode. Further, $\Delta P_{TVH}$ that stores the calculation results of the heating only operation mode is replaced with $\Delta P_{TVC}$ that stores the calculation results of the cooling only operation mode and the controller 50 carries out the same control.

With the above control, the flow rate of the refrigerant in the heat exchangers related to heat medium 15*a* and 15*b* will be the same, and control is carried out so that the flow rate of the heat medium is the same in the heat exchangers related to heat medium 15*a* and 15*b* and so that the amount of heat exchange is the same in the heat exchangers related to heat medium 15*a* and 15*b* in order for the subcooling to be at a target value. Thus, the maximum capacity of each of the heat exchangers related to heat medium 15*a* and 15*b* can be exhibited and efficient operation can be performed.

Here, the expansion devices 16*a* and 16*b* carries out the changing operation of opening degree at a certain control cycle. For example, if the control of the first heat medium flow switching devices 22*a* to 22*d* and the second heat medium flow switching devices 23*a* to 23*d* is carried out before the control cycle of the expansion devices 16*a* and 16*b*, the change in the opening degree of each of the expansion devices 16*a* and 16*b* cannot be reflected to the first heat medium flow switching devices 22*a* to 22*d* and second heat medium flow switching devices 23*a* to 23*d*. Because of this, hunting and the like occurs hampering stable control. Accordingly, the control cycle of the first heat medium flow switching devices 22*a* to 22*d* and the second heat medium flow switching devices 23*a* to 23*d* needs to be longer than the control cycle of the expansion devices 16*a* and 16*b*. Preferably, the control cycle of the first heat medium flow switching devices 22*a* to 22*d* and the second heat medium flow switching devices 23*a* to 23*d* may be more than twice as longer than the control cycle of the expansion devices 16*a* and 16*b*.

Further, if $\Delta P_{TVH}$ and $\Delta P_{TVC}$ are set to zero upon activation of the apparatus after installation, when the equipment is started up in heating only operation mode or cooling only operation mode for the first time, the opening degrees of the first heat medium flow switching devices 22*a* to 22*d* and the second heat medium flow switching devices 23*a* to 23*d* will be set to a medium opening degree or to an opening degree that is close to the medium opening degree.

However, $\Delta P_{TVH}$ and $\Delta P_{TVC}$ are determined to a certain extent by the installation conditions of the apparatus. Thus, if the opening degree is set to zero every time the apparatus is stopped or is switched to another operation mode, it will take time for the opening degree to reach a predetermined opening degree after resuming in heating only operation mode or cooling only operation mode, and efficiency will drop.

Thus, the controller 50 can temporarily store the calculated $\Delta P_{TVH}$ and $\Delta P_{TVC}$ in the storage means, and set the opening degree so that it will reflect the stored value when carrying out the next operation. For example, when operation is carried out such that the heating only operation mode is temporarily switched to the heating main operation mode, and, after a certain time, is switched to the heating only operation mode again, the controller 50 can store the $\Delta P_{TVH}$ that has been calculated during the operation of the preceding heating only operation mode in the storage means. Then, when subsequently operating in the heating only operation mode, the operation may be carried out such that the first heat medium flow switching devices 22*a* to 22*d* and the second heat medium flow switching devices 23*a* to 23*d* corresponding to the indoor units 2 that are associated with heating are set to an opening degree that is deviated by $\Delta P_{TVH}$ from the medium opening degree. With the above, the time for the operation to become stable can be shortened and effective operation can be carried out.

As described above, in the air-conditioning apparatus 100 of Embodiment 1, during the cooling only operation mode or the heating only operation mode, the controller 50 controls the opening degrees of the second heat medium flow switching devices 23 such that the flow rate of the heat medium flowing out into the heat exchangers related to heat medium 15*a* and 15*b* are the same irrespective of the resistance in each passage. Accordingly, since the refrigerant flow rates of the heat exchangers related to heat medium 15*a* and 15*b* are set to be equal so that the heat exchange amount therein is equal, energy efficiency is improved and energy savings is achieved. Here, by controlling the opening degrees of the first heat medium flow switching devices 22 in the same manner, the relationship of the inflow and outflow of the heat medium in the heat exchangers related to heat medium 15 and each of the use side heat exchangers 26 can be made the same. Further, by controlling the opening degrees of the first heat medium flow switching devices 22 and the second heat medium flow switching devices 23 corresponding to the indoor units 2 that are in operation in the same manner, control can be carried out without any flow control device or the like.

Furthermore, since the opening degrees of the first heat medium flow switching devices 22 and the second heat medium flow switching devices 23 are changed by calculating the change amount of the opening degrees $\Delta P_{TVH}$ and $\Delta P_{TVC}$ on the basis of the differential value of the opening degrees of the expansion devices 16*a* and 16*b*, the opening degrees of the expansion devices 16, the first heat medium flow switching devices 22, and the second heat medium flow switching devices 23 can be controlled cooperatively. When calculating, since a constant α, which corrects the difference in the passage resistance of the pipings of the refrigerant flowing in an out on the heat exchanger related to heat medium 15*a* side and heat exchanger related to heat medium 15*b* side, is considered, the change amount of the opening degrees $\Delta P_{TVH}$ and $\Delta P_{TVC}$ of the first heat medium flow switching devices 22 and the second heat medium flow switching devices 23 can be calculated on the basis of the state of the refrigerant circuit side. The energy efficiency while heating and cooling the heat medium can be improved by controlling the opening degrees of the expansion devices 16 so that when in the heating only operation mode, the degree of subcooling on the refrigerant outlet side of the corresponding heat exchanger related to heat medium 15 is constant, and when in the cooling only operation mode, the degree of superheat on the refrigerant outlet side of the corresponding heat exchanger related to heat medium 15 is calculated and is made constant.

Here, since the controller 50 controls the cycle of the opening degree control of the first heat medium flow switching devices 22 and the second heat medium flow switching devices 23 to be longer than the cycle of the opening degree control of the expansion devices 16, that is, more than twice in ratio, changes in the opening degree of the expansion devices 16 can be efficiently reflected to the calculation of the change amount of the opening degree of the first heat medium flow switching devices 22 and the second heat medium flow switching devices 23.

Further, since after the installation of the air-conditioning apparatus, during the first start of the cooling only operation mode or the heating only operation mode, the opening degrees of the first heat medium flow switching devices 22 and the second heat medium flow switching devices 23 are set to a medium opening degree and in the subsequent start of the operation, the opening degrees are set based on the change amount of the opening degrees of the preceding operation, the time to reach the target opening degree can be shortened and the circulation of the heat medium can be stabilized promptly. Here, by making the storage means store the change amount of each of the opening degrees during heating only operation mode and cooling only operation mode, the opening degree appropriate to the operation mode can be set.

Embodiment 2

In the above-described Embodiment, equation (2) is expressed where constant α is the resistance difference between the passage of the heat exchangers related to heat medium 15*a* and 15*b* on the refrigerant side. If the resistance (pressure loss) between the heat exchangers related to heat medium 15*a* and 15*b* is not so large, it can be dealt with equation (2). However, since the pressure loss of the refrigerant also changes with the flow rate and the like of the refrigerant, there will be a possibility of a large error when there is a large difference in the pressure loss of the refrigerant in the two heat exchangers related to heat medium.

Hence, in Embodiment 2, the control of the opening degrees of the first heat medium flow switching devices 22 and the second heat medium flow switching devices 23 is carried out on the basis of the temperature of the heat medium flowing out from the heat exchangers related to heat medium 15*a* and 15*b*.

The temperature of the heat medium on the outlet side (heat medium outlet temperature) of the heat exchangers related to heat medium 15*a* and 15*b* according to the detection of the first temperature sensors 31*a* and 31*b* is denoted as $T_{na}$ and $T_{nb}$, respectively. During heating only operation, under a state in which all of the indoor units 2*a* to 2*b* are performing heating, when all of the opening degrees of the first heat medium flow switching devices 22*a* to 22*b* and second heat medium flow switching devices 23*a* to 23*d* are changed by a certain value, the flow rate of the heat medium flowing in each of the heat exchangers related to heat medium 15*a* and 15*b* change. Accordingly, the temperature effectiveness of the heat exchangers related to heat medium 15*a* and 15*b* change, and the heat medium outlet temperatures $T_{na}$ and $T_{nb}$ also change.

In Embodiment 2, the value calculated with the same equation (1) of Embodiment 1 will be denoted as gain $G_{TLH}$. This $G_{TLH}$ is calculated through experiment and the like in advance and is stored in the storage means 71 as data.

Figure 9:
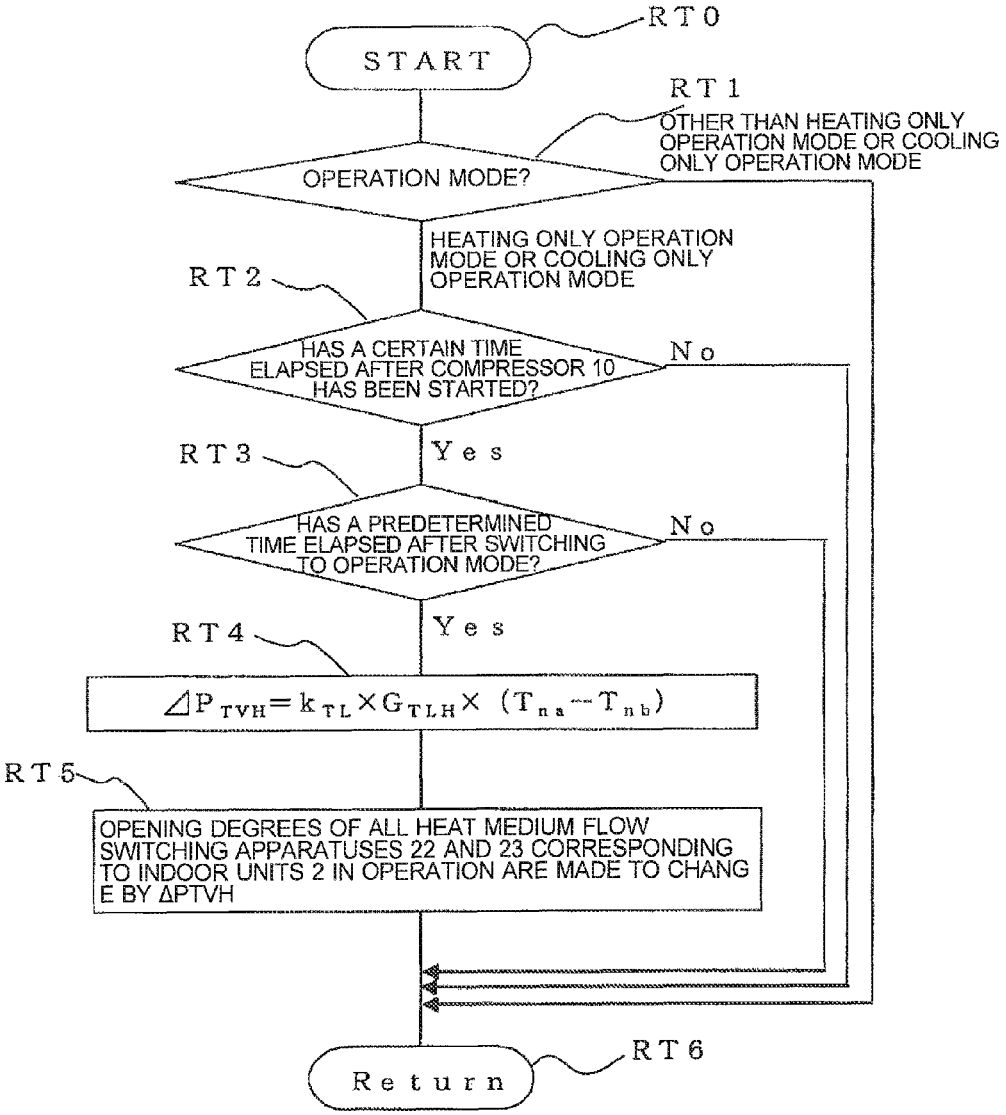
FIG. 9 is a flow chart of the operation of the controller 50 of Embodiment 1.

FIG. 9 is a diagram illustrating a flow chart of the controller 50 of Embodiment 2. The control of the opening degrees of the first heat medium flow switching devices 22*a* to 22*d* and the second heat medium flow switching devices 23*a* to 23*d* will be described with reference to FIG. 9. The controller 50 starts a control for each control cycle at a certain interval (every one minute, for example) (RT0). Then, it is determined whether the operation mode is in the heating only operation mode, the cooling only operation mode, or other operation modes (RT1).

When in the heating only operation mode or the cooling only operation mode, it is determined whether a certain time (ten minutes, for example) has elapsed after the start of the compressor 10 (RT2). When it is determined that a certain time has elapsed, it is further determined whether a predetermined time (ten minutes, for example) has elapsed after switching to the heating only operation mode or the cooling only operation mode (RT3). When it is determined that the predetermined time has elapsed after switching of the operation mode, calculation is performed with the following equation (3) (RT4). Here, $K_{TL}$ denotes a constant (relaxation coefficient, 0.3, for example), $G_{TLH}$ denotes the gain obtained with equation (1), $\Delta P_{TVH}$ denotes the change amount of the opening degrees of the first heat medium flow switching devices 22*a* to 22*b* and the second heat medium flow switching devices 23*a* to 23*b*.

$$\Delta P_{TVH}=k_{TL}\times G_{TLH}\times(T_{na}-T_{nb}) \tag{3}$$

Then the opening degrees of the first heat medium flow switching devices 22 and the second heat medium flow switching devices 23 corresponding to the indoor units 2 that are in operation are changed by $\Delta P_{TVH}$ (RT5), and the process is repeated (Rt6). Further, the process is also repeated in RT1, RT2, and RT3, when it is determined that the operation mode is one other than the heating only operation mode or the cooling only operation mode, that a certain time has not elapsed after the start of the compressor 10, and that a predetermined time has not elapsed after switching to the heating only operation mode (RT6).

For example, it is assumed that gain $G_{TLH}$ is 10, $k_{TL}$ is 0.3, and the medium opening degree of the opening degree $P_{TVH}$ of the heat medium flow switching devices 22*a* to 22*d* and 23*a* to 23*d* is 800. Regarding the expansion devices 16*a* and 16*b*, a case in which the flow rate of the refrigerant flowing into the heat exchanger related to heat medium 15*a* and heat exchanger related to heat medium 16*a* and the heat exchanger related to heat medium 15*a* are smaller than the flow rate of the refrigerant flowing into the heat exchanger related to heat medium 15*b* in a negatively stable state will be considered.

Here, the temperatures of the heat medium on the inlet side of the heat exchangers related to heat medium 15*a* and 15*b* are of the same temperature. Further, in the heat exchanger related to heat medium 15*a*, the flow rate of the refrigerant is less than that of the heat exchanger related to heat medium 15*b*. Accordingly, the temperature effectiveness is improved since the amount of heat medium is small. Thus, the heat medium outlet temperature $T_{na}$ of the heat exchanger related to heat medium 15*a* has a higher heat medium temperature than the heat medium outlet temperature $T_{nb}$ of the heat exchanger related to heat medium 15*b*. For example, if $T_{na}$ is higher than $T_{nb}$ by two degrees C., $\Delta P_{TVH}$ will be 6 from equation (4). Accordingly, the controller 50 controls all of the first heat medium flow switching devices 22 and the second heat medium flow switching devices 23 corresponding to the indoor units 2 that are in operation such that the opening degree are increased by 6 pulses.

Thus, increasing the opening degrees of the first heat medium flow switching devices 22 and the second heat medium flow switching devices 23 increases the flow rate of the heat medium flowing in the heat exchanger related to heat medium 15*a*. By this, the flow rate of the refrigerant flowing in the heat exchanger related to heat medium 15*a* is increased and the flow rate of the refrigerant flowing in the heat exchanger related to heat medium 15*b* is decreased. Therefore, control is carried out such that the flow rates of the refrigerant flowing in the two heat exchangers related to heat medium are equalized.

Here, in Embodiment 2, the control cycle of the first heat medium flow switching devices 22*a* to 22*d* and the second heat medium flow switching devices 23*a* to 23*d* is set longer than the control cycle of the heat medium flow control devices 25*a* to 25*d* in order to prevent hatching and achieve stable control. Preferably, the control cycle of the first heat medium flow switching devices 22*a* to 22*d* and the second heat medium flow switching devices 23*a* to 23*d* may be more than twice as longer than the control cycle of the heat medium flow control devices 25*a* to 25*d*.

Further, the control method during cooling only operation mode is the same as that during the heating only operation mode. For example, gain $G_{TLH}$ of the heating only operation mode in equations (3) and (4) is replaced with gain $G_{TLC}$ of the cooling only operation mode. Further, $\Delta P_{TVH}$ that stores the calculation results of the heating only operation mode is replaced with $\Delta P_{TLC}$ that stores the calculation results of the cooling only operation mode and the controller 50 carries out the same control.

As described above, in the air-conditioning apparatus of Embodiment 2, since the controller 50 changes the opening degrees of the first heat medium flow switching devices 22 and the second heat medium flow switching devices 23 by calculating the change amount of the opening degrees $\Delta P_{TVH}$ and $\Delta P_{TVC}$ on the basis of the differential value of the heat medium outlet temperatures $T_{na}$ and $T_{nb}$ according to the detection of the first temperature sensors 31*a* and 31*b*, the opening degrees of the expansion devices 16, the first heat medium flow switching devices 22, and the second heat medium flow switching devices 23 can be controlled cooperatively. Since the calculation is based on the heat medium outlet temperatures $T_{na}$ and $T_{nb}$, the change amount of the opening degrees $\Delta P_{TVH}$ and $\Delta P_{TVC}$ of the first heat medium flow switching devices 22 and the second heat medium flow switching devices 23 can be calculated on the basis of the state of the refrigerant circuit side, such as the passage resistance.

Embodiment 3

Although not specifically described in the above Embodiments, the first heat medium flow switching devices 22 and the second heat medium flow switching devices 23 may include electronic expansion valves capable of changing flow rates of two passages used in combination. Furthermore, while an exemplary description in which the heat medium flow control devices 25 each include a two-way valve has been given, each of the heat medium flow control devices 25 may include a control valve having three passages and the valve may be disposed with a bypass pipe that bypasses the corresponding use side heat exchanger 26.

Additionally, each use side heat medium flow control device 25 may be a two-way valve or a three way valve having one way closed. Alternatively, as regards each use side heat medium flow control device 25, a component, such as an on-off valve, which is capable of opening or closing a two-way passage, may be used while ON and OFF operations are repeated to control an average flow rate.

Furthermore, while each second refrigerant flow switching device 18 has been described as if it is a four-way valve, the device is not limited to this type. The device may be configured such that the refrigerant flows in the same manner using a plurality of two-way flow switching valves or three-way flow switching valves.

While the air-conditioning apparatus 100 according to the above Embodiments has been described with respect to the case in which the apparatus can perform the cooling and heating mixed operation, the apparatus is not limited to the case. Even in an apparatus that is configured by a single heat exchanger related to heat medium 15 and a single expansion device 16 that are connected to a plurality of parallel use side heat exchangers 26 and heat medium flow control valves 25, and is capable of carrying out only a cooling operation or a heating operation, the same advantages can be obtained.

In addition, it is needless to say that the same holds true for the case in which only a single use side heat exchanger 26 and a single heat medium flow control valve 25 are connected. Moreover, it is needless to say that no problem will arise even if the heat exchanger related to heat medium 15 and the expansion device 16 acting in the same manner are arranged in plural numbers. Furthermore, while the case in which the heat medium flow control valves 25 are equipped in the heat medium relay unit 3 has been described, the arrangement is not limited to this case. Each heat medium flow control valve 25 may be disposed in the indoor unit 2. The heat medium relay unit 3 and the indoor unit 2 may be constituted in different housings.

As regards the heat source side refrigerant, a single refrigerant, such as R-22 or R-134a, a near-azeotropic refrigerant mixture, such as R-410A or R-404A, a non-azeotropic refrigerant mixture, such as R-407C, a refrigerant, such as $CF_3CF{=}CH_2$, containing a double bond in its chemical formula and having a relatively low global warming potential, a mixture containing the refrigerant, or a natural refrigerant, such as carbon dioxide ($CO_2$) or propane, can be used. Here, while the heat exchanger related to heat medium 15*a* or the heat exchanger related to heat medium 15*b* is operating for heating, a refrigerant that typically changes between two phases is condensed and liquefied and a refrigerant that turns into a supercritical state at temperatures exceeding the critical temperature, such as $CO_2$, is cooled in the supercritical state. As for the rest, either of the refrigerant acts in the same manner and offers the same advantages.

As regards the heat medium, for example, brine (anti-freeze), water, a mixed solution of brine and water, or a mixed solution of water and an additive with high anticorrosive effect can be used. In the air-conditioning apparatus 100, therefore, even if the heat medium leaks into the indoor space 7 through the indoor unit 2, because the heat medium used is highly safe, contribution to improvement of safety can be made.

Further, although the heat source side heat exchanger 12 and the use side heat exchangers 26*a* to 26*d* are typically arranged with an air-sending device in which condensing or evaporation is facilitated by the sent air, not limited to the above, a panel heater, using radiation can be used as the use side heat exchangers 26*a* to 26*d* and a water-cooled heat exchanger which transfers heat using water or antifreeze can be used as the heat source side heat exchanger 12. Any component that has a structure that can transfer or remove heat may be used.

Furthermore, while an exemplary description in which there are four use side heat exchangers 26*a* to 26*d* has been given, any number can be connected.

Furthermore, description has been made illustrating a case in which there are two heat exchangers related to heat medium 15, namely, heat exchanger related to heat medium 15*a* and heat exchanger related to heat medium 15*b*. As a matter of course, the arrangement is not limited to this case, and as long as it is configured so that cooling and/or heating of the heat medium can be carried out, the number may be any number.

Furthermore, each of the number of pumps 21*a* and 21*b* is not limited to one. A plurality of pumps having a small capacity may be used in parallel.

In the above Embodiments, although the controller 50 controlled the flow rates of the heat medium flowing in the heat exchangers related to heat medium 15*a* and 15*b* to be the same on the basis of the opening degrees and the like of the expansion devices 16*a* and 16*b*, control may be performed by disposing a flow sensor or the like.

REFERENCE SIGNS LIST 1 outdoor unit; 1B outdoor unit; 2 indoor unit; 2*a* indoor unit; 2*b* indoor unit; 2*c* indoor unit; 2*d* indoor unit; 3 heat medium relay unit; 3B heat medium relay unit; 3*a* main heat medium relay unit; 3*b* sub heat medium relay unit; 4 refrigerant piping; 4*a* first connecting piping; 4*b* second connecting piping; 5 piping; 6 outdoor space; 7 indoor space; 8 space; 9 structure; 10 compressor; 11 first refrigerant flow switching device; 12 heat source side heat exchanger; 13*a* check valve; 13*b* check valve; 13*c* check valve; 13*d* check valve; 14 gas-liquid separator; 15 heat exchanger related to heat medium; 15*a* heat exchanger related to heat medium; 15*b* heat exchanger related to heat medium; 16 expansion device; 16*a* expansion device; 16*b* expansion device; 16*c* expansion device; 17 on-off device; 17*a* on-off device; 17*b* on-off device; 17*c* on-off device; 17*d* on-off device; 17*e* on-off device; 17*f* on-off device; 18 second refrigerant flow switching device; 18*a* second refrigerant flow switching device; 18*b* second refrigerant flow switching device; 19 accumulator; 21 pump; 21*a* pump; 21*b* pump; 22 first heat medium flow switching device; 22*a* first heat medium flow switching device; 22*b* first heat medium flow switching device; 22*c* first heat medium flow switching device; 22*d* first heat medium flow switching device; 23 second heat medium flow switching device; 23*a* second heat medium flow switching device; 23*b* second heat medium flow switching device; 23*c* second heat medium flow switching device; 23*d* second heat medium flow switching device; 25 heat medium flow control device; 25*a* heat medium flow control device; 25*b* heat medium flow control device; 25*c* heat medium flow control device; 25*d* heat medium flow control device; 26 use side heat exchanger; 26*a* use side heat exchanger; 26*b* use side heat exchanger; 26*c* use side heat exchanger; 26*d* use side heat exchanger; 31 first temperature sensor; 31*a* first temperature sensor; 31*b* first temperature sensor; 34 second temperature sensor; 34*a* second temperature sensor; 34*b* second temperature sensor; 34*c* second temperature sensor; 34*d* second temperature sensor; 35 third temperature sensor; 35*a* third temperature sensor; 35*b* third temperature sensor; 35*c* third temperature sensor; 35*d* third temperature sensor; 36 pressure sensor; 41 flow switching device; 42 flow switching device; 50 controller; 100 air-conditioning apparatus; 100A air-conditioning apparatus; 100B air-conditioning apparatus; A refrigerant circuit; B heat medium circuit.

The invention claimed is:

1. An air-conditioning apparatus, comprising:

a refrigeration cycle device constituted by a refrigerant circuit, the refrigerant circuit being connected by piping including a compressor that compresses a refrigerant, a refrigerant flow switching device that switches a circulation path of the refrigerant, a heat source side heat exchanger for exchanging heat with the refrigerant, a plurality of heat medium heat exchangers each heating or cooling a heat medium different than the refrigerant by heat exchange with the refrigerant, and a plurality of expansion devices each controlling a flow rate of the refrigerant flowing in a respective heat medium heat exchanger by controlling pressure of the refrigerant;

a heat medium side device constituted by a heat medium circuit, the heat medium circuit being connected by piping including the heat medium heat exchangers, a heat medium delivery device for circulating the heat medium in the heat medium circuit, and a plurality of use side heat exchangers, each use side heat exchanger exchanging heat between the heat medium and air related to a conditioned space;

a plurality of heat medium flow switching devices, a heat medium flow switching device disposed on an inflow side and a heat medium flow switching device disposed on an outflow side of each of the use side heat exchangers in the heat medium circuit, the heat medium flow switching devices disposed on the inflow side of the use side heat exchangers merging the heat medium from the plurality of heat medium heat exchangers and the heat medium flow switching devices disposed on the outflow side of the use side heat exchangers diverging the heat medium to the plurality of heat medium heat exchangers by controlling with a controller the degree to which ports of the heat medium flow switching devices are opened, which controls the amount of heat exchange of each of the heat medium heat exchangers, during a cooling only operation mode in which all of the heat medium heat exchangers performs cooling and during a heating only operation mode in which all of the heat medium heat exchangers performs heating, wherein the controller calculates a correction value of opening degrees of the heat medium flow switching devices on the basis of data of individual opening degrees of each of the plurality of expansion devices and performs control in which the opening degrees of the heat medium flow switching devices are changed by the correction value of the opening degrees.

2. The air-conditioning apparatus of claim 1, wherein the data of the opening degrees is a difference value of the opening degrees of the expansion devices.

3. The air-conditioning apparatus of claim 1, wherein the correction value of the opening degrees of the heat medium flow switching devices is calculated based on a constant that is a value based on a difference in passage resistance of the pipings of the refrigerant flowing in and out of the heat medium heat exchangers.

4. An air-conditioning apparatus, comprising:

a refrigeration cycle device constituted by a refrigerant circuit, the refrigerant circuit being connected by piping including a compressor that compresses a refrigerant, a refrigerant flow switching device that switches a circulation path of the refrigerant, a heat source side heat exchanger for exchanging heat with the refrigerant, a plurality of heat medium heat exchangers each heating or cooling a heat medium different than the refrigerant by heat exchange with the refrigerant, and a plurality of expansion devices each controlling a flow rate of the refrigerant flowing in a respective heat medium heat exchanger by controlling pressure of the refrigerant;

a heat medium side device constituted by a heat medium circuit, the heat medium circuit being connected by piping including the heat medium heat exchangers, a heat medium delivery device for circulating the heat medium in the heat medium circuit, and a plurality of use side heat exchangers, each use side heat exchanger exchanging heat between the heat medium and air related to a conditioned space;

a plurality of heat medium flow switching devices, a heat medium flow switching device disposed on an inflow side and a heat medium flow switching device disposed on an outflow side of each of the use side heat exchangers in the heat medium circuit, the heat medium flow switching devices disposed on the inflow side of the use side heat exchangers merging the heat medium from the plurality of heat medium heat exchangers and the heat medium flow switching devices disposed on the outflow side of the use side heat exchangers diverging the heat medium to the plurality of heat medium heat exchangers by controlling with a controller the degree to which ports of the heat medium flow switching devices are opened, which controls the amount of heat exchange of each of the heat medium heat exchangers, during a cooling only operation mode in which all of the heat medium heat exchangers performs cooling and during a heating only operation mode in which all of the heat medium heat exchangers performs heating, and temperature detection devices that detect the temperatures of the heat medium flowing out from the heat medium heat exchangers, wherein the controller calculates a correction value of the opening degrees of the heat medium flow switching devices on the basis of temperatures detected by the temperature detection devices and performs control in which the opening degrees of the heat medium flow switching devices are changed by the correction value of the opening degree.

5. The air-conditioning apparatus of claim 4, wherein, the number of heat medium heat exchangers is two, and the correction value of the opening degrees of the heat medium flow switching devices is calculated on the basis of a temperature difference of the heat medium flowing out from each of the two heat medium heat exchangers.

6. The air-conditioning apparatus of claim 1, wherein the controller controls a cycle of opening degree control of the heat medium flow switching devices to extend for an amount of time past a cycle of opening degree control of the expansion devices, and the ratio of the control cycle of the heat medium flow switching devices to the control cycle of the expansion devices is 2 or more.

7. The air-conditioning apparatus of claim 1, further comprising a heat medium flow control device that controls a flow rate of the heat medium flowing in and out of a corresponding use side heat exchanger, wherein the control cycle of the heat medium flow switching devices is longer than a control cycle of the heat medium flow control devices.

8. The air-conditioning apparatus of claim 7, wherein the ratio of the control cycle of the heat medium flow switching devices to the control cycle of the heat medium flow control device is 2 or more.

9. The air-conditioning apparatus of claim 1, wherein during a first start of an operation of the cooling only operation mode or the heating only operation mode after installation, the opening degrees of the heat medium flow switching devices are each set to an initial opening degree that are the same or are substantially the same, and when starting the operation for a second time or after, and a correction value of the opening degrees has been calculated, a correction value of the opening degrees calculated last in a preceding operation is added to the initial opening degree.

10. The air-conditioning apparatus of claim 9, wherein the controller stores in a storage means the correction value of the opening degree of the heating only operation mode and the correction value of the opening degree of the cooling only operation mode.

11. The air-conditioning apparatus of claim 1, wherein the controller during cooling only operation mode, calculates the degree of superheat of the refrigerant on an outlet side of each of the heat medium heat exchangers and controls the opening degree of each of the expansion devices such that the degree of superheat of each of the heat medium heat exchangers are at a constant value, and during heating only operation mode, calculates the degree of subcooling of the refrigerant on an outlet side of each of the heat medium heat exchangers and controls the opening degree of each of the expansion devices such that the degree of subcooling of each of the heat medium heat exchangers are at a constant value.

12. The air-conditioning apparatus of claim 1, wherein the controller controls the opening degrees of the heat medium flow switching devices on the inflow side and the outflow side to be a substantially same opening degree.

13. The air-conditioning apparatus of claim 1, wherein the controller controls the heat medium flow switching devices corresponding to the plurality of use side heat exchangers of an indoor unit in operation such that the opening degrees are uniformly changed by the correction value of the opening degree.

14. The air-conditioning apparatus of claim 1, wherein the indoor unit including the plurality of use side heat exchangers; a heat medium relay unit including the heat medium heat exchangers, the heat medium delivery device, and the heat medium flow switching devices; and an outdoor unit including the compressor and heat source side heat exchanger are each formed in a different housing, capable of being disposed in places apart from each other.

* * * * *